US012078364B2

(12) United States Patent
Bertolotti et al.

(10) Patent No.: US 12,078,364 B2
(45) Date of Patent: Sep. 3, 2024

(54) MANIFOLD FOR THE DISTRIBUTION OF A FLUID IN A PLUMBING AND HEATING SYSTEM AND RELATIVE DISTRIBUTION KIT

(71) Applicant: I.V.A.R. S.P.A., Prevalle (IT)

(72) Inventors: Umberto Bertolotti, Prevalle (IT); Mario Contini, Flero (IT)

(73) Assignee: I.V.A.R. S.P.A., Prevalle (IT)

( * ) Notice: Subject to any disclaimer, the term of this patent is extended or adjusted under 35 U.S.C. 154(b) by 69 days.

(21) Appl. No.: 17/772,217

(22) PCT Filed: Oct. 13, 2020

(86) PCT No.: PCT/IB2020/059595
§ 371 (c)(1),
(2) Date: Apr. 27, 2022

(87) PCT Pub. No.: WO2021/084357
PCT Pub. Date: May 6, 2021

(65) Prior Publication Data

US 2022/0397288 A1 Dec. 15, 2022

(30) Foreign Application Priority Data

Oct. 28, 2019 (IT) ..... 102019000019880

(51) Int. Cl.
*F24D 3/10* (2006.01)
*F24D 19/00* (2006.01)
*F24D 19/10* (2006.01)

(52) U.S. Cl.
CPC ..... *F24D 3/1066* (2013.01); *F24D 19/0097* (2013.01); *F24D 19/1009* (2013.01); *F24D 19/1015* (2013.01)

(58) Field of Classification Search
CPC ..... F24D 3/1066; F24D 19/1009; F24D 19/1015; F24D 19/0097; Y10T 137/0402; Y10T 137/0447
(Continued)

(56) References Cited

U.S. PATENT DOCUMENTS 4,770,341 A * 9/1988 Drake ..... F16L 41/03 137/271
4,848,391 A * 7/1989 Miller ..... F24D 3/1075 137/884
(Continued)

FOREIGN PATENT DOCUMENTS

EP 0903543 A2 3/1999
KR 101082964 B1 11/2011
(Continued)

OTHER PUBLICATIONS

Search Report dated Dec. 23, 2020 in corresponding International Application No. PCT/IB2020/059595, 3 pages.
(Continued)

*Primary Examiner* — William M McCalister
(74) *Attorney, Agent, or Firm* — MH2 TECHNOLOGY LAW GROUP LLP

(57) ABSTRACT

A manifold for the distribution of a fluid in a plumbing and heating system has a tubular shape and defines in its interior a distribution conduit for the fluid. The manifold extends between a first inlet/outlet end and a second inlet/outlet end, both of which are designed to put the distribution conduit in communication with the exterior of the manifold to receive incoming fluid or to send fluid exiting the manifold. The manifold comprises a plurality of branches arranged in series along a longitudinal extension and interposed between the first and second inlet/outlet ends, wherein each branch allows a quantity of fluid to enter into or exit from the distribution conduit. Each branch is provided with an access
(Continued)

or exit opening having a respective axis, and the branches are positioned in the manifold in such a way that: the distance between the first inlet/outlet end and the axis of the first branch is equal to an initial stretch, the centre-to-centre distance between the axis of each branch and the axes of the adjacent branches is equal to a centre-to-centre distance measurement between the branches, and the distance between the axis of the last branch and the second inlet/outlet end is equal to a final stretch. The length of the final stretch is equal to the sum of the length of the initial stretch and half of the centre-to-centre distance measurement.

15 Claims, 7 Drawing Sheets

(58) Field of Classification Search
USPC ..... 137/15.01, 15.09
See application file for complete search history.

(56) References Cited

U.S. PATENT DOCUMENTS 5,950,575 A * 9/1999 Simons ..... F24D 3/1066 137/561 A
7,714,035 B1 * 5/2010 Coe ..... F16L 47/32 138/140
10,989,188 B2 * 4/2021 Surjaatmadja ..... F04B 53/10
2005/0257843 A1 * 11/2005 Simensen ..... F24D 3/1066 137/884
2008/0276998 A1 * 11/2008 Boyher ..... F16L 41/03 137/561 A
2010/0089552 A1 * 4/2010 Vu ..... F28D 21/0007 165/104.19
2010/0278951 A1 * 11/2010 Tiberghien ..... F24D 3/1075 137/884
2011/0220219 A1 * 9/2011 Ellis ..... F16L 41/03 137/15.21
2012/0048381 A1 * 3/2012 MacDuff ..... F24D 3/1066 165/104.31
2012/0298226 A1 * 11/2012 Struempler ..... F24F 3/06 137/561 A
2020/0063980 A1 * 2/2020 Sørensen ..... F24D 3/125
2022/0397288 A1 * 12/2022 Bertolotti ..... F24D 3/1066

FOREIGN PATENT DOCUMENTS

KR 20120015085 A 2/2012
KR 200473804 Y1 8/2014

OTHER PUBLICATIONS

Written Opinion dated Dec. 23, 2020 in corresponding International Application No. PCT/IB2020/059595, 8 pages.

* cited by examiner

MANIFOLD FOR THE DISTRIBUTION OF A FLUID IN A PLUMBING AND HEATING SYSTEM AND RELATIVE DISTRIBUTION KIT

CROSS-REFERENCE TO RELATED APPLICATIONS

This application is a U.S. National Stage application of PCT/IB2020/059595, filed Oct. 13, 2020, pending, which claims priority to Italian Patent Application No. 102019000019880, filed Oct. 28, 2019, the entire disclosures of which are hereby incorporated by reference in their entireties.

The present invention relates to a manifold for distributing a fluid, typically water, circulating in a plumbing and heating system. Furthermore, the present invention relates to a distribution kit for plumbing and heating systems, a mixing system and methods for assembling distribution kits and mixing systems for plumbing and heating systems.

The invention finds advantageous application in the context of water or plumbing and heating systems for heat regulation and/or for the distribution of domestic hot water in residential, commercial or industrial buildings. The invention is particularly suitable for use in mixing and booster groups for radiant systems.

As is known, heating systems, or systems for supplying domestic hot water, comprise control units or boxes comprising a series of components and devices necessary for the correct operation of the system.

These control units typically include one or more water distribution (or mixing) systems, which are responsible for mixing the flows of hot and cold water in a controlled manner, controlling the flow of water in the various conduits and branches of the system, and in general distributing the water according to the needs and operating modes of the system (for example based on the request of the radiant elements placed in the various rooms, or in the coils of the floor heating system).

Distribution systems usually comprise at least one delivery branch and one return branch. The delivery branch includes a delivery manifold provided with a series of branches through which the flow is sent to the various utilities, which may be radiant elements, coils, points of use, etc. In general, each branch corresponds to a specific area of the system (for example a room). The delivery branch comprises a respective return manifold, provided with a series of branches which receive the flow of water returning from the various utilities. The distribution system then comprises a set of valves (together with control units, pumps, accessories, etc.) that manage the flow of water in delivery and return, the circulation to and from the boiler, etc.

The manifolds, whether they are delivery or return, typically have a pipe shape, on which holes are made, orthogonal to the extension of the pipe, which correspond to the branches. Taps, valves, flow meters, lockshields or other flow control devices may be mounted to these holes. A respective conduit extends from each branch which sends a flow of water (in the case of the delivery manifold) or receives a flow of water (in the case of the return manifold).

Typically, the layout of a distribution (or mixing) system provides that the two delivery and return manifolds are arranged horizontally, parallel to each other and one above the other, while all the conduits branch off from the branches going down or rising upwards, if installed in basements and the like (and then usually continue below a floor).

On one side of the two manifolds (for example on the left) there are control valves, pumps and other conduits interposed between delivery and return, while on the opposite side of the manifolds (for example on the right) there may be additional system continuation pipes or other devices, or the manifolds may be plugged.

Typically, the two manifolds are mounted on the wall, or on an internal wall of a suitable box fixed to the wall, by means of special assembly brackets. Usually, each system is provided with a pair of vertical brackets, one placed on the left side and hooked to the two manifolds, and one placed on the right side and in turn hooked to the two manifolds; as a whole, each manifold is supported in two distinct points by the two brackets. The assembly brackets may be made of metal or plastic, and comprise rings or clamps which wrap the manifold and, once tightened, firmly fix the manifolds to the assembly wall.

As illustrated above, all the conduits of the two manifolds branch off from their respective branches, for example going downwards; this means that the conduits that branch off from the upper manifold (for example return) meet at the bottom the lower manifold (for example delivery), and are then passed behind it, between the lower manifold and the assembly wall, and then continue downwards, together with the conduits branching off from the same lower manifold.

This assembly method therefore provides that, through the brackets, the two manifolds are placed horizontally and one above the other but posteriorly distanced from the wall on which they are mounted by means of the brackets. In particular, a space must be provided at least between the lower manifold and the wall, since the conduits coming from the upper manifold pass behind it. To achieve this, the brackets are suitably shaped or bent in such a way as to fix the manifolds at a certain distance from the assembly wall.

The Applicant has found that this known solution is not free from drawbacks and can be improved under various aspects.

In particular, when assembling the distribution system, once the brackets have been fixed and the manifolds have been mounted, it is difficult for the operator to mount all the conduits that branch off from the manifold branches. The complexity and inconvenience of assembly is particularly relevant for the conduits that branch off from the branches of the upper manifold and which must pass behind the lower manifold, between the latter and the assembly wall, and then continue further below the lower manifold. In fact, the space available is very limited (if the manifolds were very detached from the wall, the system would have an excessive and unacceptable bulk in depth) and this makes it difficult to pass the conduits and use tools for assembly. The problem is even more relevant if we consider that—typically—the centre-to-centre distance, i.e. the lateral distance, between two adjacent branches of a manifold is a standard measure (for example 40 mm or 50 mm) therefore the branches of the upper manifold are vertically aligned with the branches of the lower manifold, and this means that the conduits branching off from the upper manifold must pass just behind the branches and respective conduits of the lower manifold. Moreover, at the branches there are typically valves, taps or flow meters, which have their own overall dimensions and reduce the useful space for the passage of the conduits coming from the upper manifold. At the branches of the lower manifold it is therefore necessary to combine the simultaneous presence of a conduit coming from the upper manifold (which must pass behind a corresponding branch of the lower manifold), the branch itself provided with its own valve or regulation device, and the conduit which starts from the branch below the lower manifold.

It is therefore apparent that this configuration makes assembly operations complex and laborious, which can take a long time to complete.

Alternatively, a different assembly of the two manifolds in the distribution system is known, which provides for staggering the positions of the branches of the upper manifold with respect to the branches of the lower manifold. By using, for example, different assembly brackets, or using the brackets in a second configuration, the two manifolds are still horizontal and placed one above the other, but with the axes of the upper and lower branches not aligned with each other, but alternating: this means that each conduit coming from the branches of the upper manifold descends and passes behind the lower manifold not at a lower branch, but in the space between two adjacent branches. This offset between the conduits branching off from the upper manifold and the conduits branching off from the lower manifold avoids having to pass exactly behind the lower branches, instead passing in the space between two branches. In this way it is also avoided that, below the lower manifold, the upper conduits are aligned behind the lower conduits; in fact, the upper conduits continue below the lower manifold interposed between two lower conduits.

Although this second solution facilitates the assembly operations by staggering the upper conduits with respect to the lower conduits, in turn has significant drawbacks.

In fact, first of all it is necessary to provide for the use of special brackets, which allow a staggered assembly of the two manifolds, with a consequent increase in costs and in items to be prepared for a complete assembly kit.

Furthermore, the staggered assembly determines a vertical misalignment between the two upper and lower manifolds: this means that one of the two manifolds "starts" in a laterally displaced position with respect to the beginning of the other manifold, and therefore the vertical alignment between the two manifolds is lost. The same happens, of course, also for the end of the manifolds (which usually have the same length), which are no longer aligned.

This constitutes a very significant drawback, since the mixing devices (valves, pumps, etc.) placed upstream or downstream of the two manifolds must be connected to them: the fact that one of the manifolds is laterally misaligned with respect to the other does not allow assembly of mixing apparatuses. Basically, there is an empty space between mixing apparatuses and the start of the manifold that has been offset in the manner described above. To correctly connect the devices upstream or downstream of the manifolds, it is necessary to have a correct vertical alignment between them. Therefore, this second solution requires the addition of spacers or extensions (or for example a nipple) that restores alignment. These additional parts introduce an additional production cost, and also force the manufacturer to be provided with a number of accessory items that can be supplied according to the different installations. Overall, this solution reduces standardization and increases the number of components necessary to implement the system.

In this situation, the object underlying the present invention, in its various aspects and/or embodiments, is to provide a manifold for the distribution of a fluid, a distribution kit for plumbing and heating systems, a mixing system and methods for assembling distribution kits and for assembling mixing systems for plumbing and heating systems which may be able to overcome one or more of the aforementioned drawbacks.

A further object of the present invention is to propose a manifold for the distribution of a fluid and a distribution kit for plumbing and heating systems which allow carrying out the assembly of a mixing system in a simple, convenient and rapid manner, in particular with respect to the known solutions.

A further object of the present invention is to propose a manifold for the distribution of a fluid and a distribution kit for plumbing and heating systems which allow the assembly of a mixing system without the need for special components.

A further object of the present invention is to propose a manifold for the distribution of a fluid and a distribution kit for plumbing and heating systems characterized by a high versatility of use in the implementation of mixing systems.

A further object of the present invention is to propose a manifold for the distribution of a fluid and a distribution kit for plumbing and heating systems characterized by a reduced manufacturing cost.

A further object of the present invention is to propose a manifold for the distribution of a fluid and a distribution kit for plumbing and heating systems which are simple and quick to manufacture.

A further object of the present invention is to propose a manifold for the distribution of a fluid and a distribution kit for plumbing and heating systems characterized by a simple and rational structure.

A further object of the present invention is to create alternative solutions, with respect to the prior art, in the manufacture of manifolds for the distribution of a fluid and mixing systems, and/or to open new design fields. These and any other objects, which will become apparent in the following description, are substantially achieved by a manifold for the distribution of a fluid, a distribution kit for plumbing and heating systems, a mixing system, a method for assembling a distribution kit and a method for assembling a mixing system for plumbing and heating systems according to one or more of the appended claims, each of which taken alone (without the relative dependent claims) or in any combination with the other claims, as well as according to the following aspects and/or embodiments, variously combined, also with the aforementioned claims.

Aspects of the invention are listed below.

In a first aspect thereof, the invention relates to a manifold for the distribution of a fluid circulating in a plumbing and heating system, having a tubular shape and defining in its interior it a distribution conduit intended to be crossed by a fluid.

In one aspect, the manifold extends longitudinally between:

- a first inlet/outlet end, suitable to put said distribution conduit in communication with the exterior of the manifold and configured to receive fluid entering the manifold or to send fluid exiting the manifold;
- a second inlet/outlet end, separate from said first inlet/outlet end, suitable to put said distribution conduit in communication with the exterior of the manifold and configured to receive fluid entering the manifold or to send fluid exiting the manifold.

In one aspect, the manifold, in use, is configured to operate with at least one of said first inlet/outlet end and second inlet/outlet end which receives fluid entering the manifold or sends fluid exiting the manifold.

In one aspect, the manifold is provided with a plurality of branches, mutually distinct and arranged in series along the longitudinal extension of the manifold, interposed between the first inlet/outlet end and the second inlet/outlet end.

In one aspect, the plurality of branches comprises at least a first branch and a final branch.

In one aspect, each branch of said plurality of branches defines a respective branch point of the manifold, at which a quantity of fluid in transit in the distribution conduit can exit the distribution conduit towards the exterior or a quantity of fluid coming from the exterior can enter the distribution conduit.

In one aspect, each branch of said plurality of branches comprises at least one respective first access or exit opening, configured to allow the exit from the manifold of at least part of the fluid in transit in the distribution conduit or the entrance of fluid inside the distribution conduit, said respective first access or exit opening being a hole having a respective axis of the branch.

In one aspect, the branches of said plurality of branches are positioned, in the manifold, in such a way that:

- the distance between the first inlet/outlet end and the axis of the first branch is equal to an initial stretch (X) of the manifold;
- the distance between the axis of each branch and the axes of adjacent branches, and/or between the axis of the first branch (6) and the axis of the subsequent branch and/or between the axis of the last branch and the axis of the previous branch, is equal to a given centre-to-centre distance measurement (A) between the branches of the manifold;
- the distance between the axis of the last branch and the second inlet/outlet end is equal to a final stretch of the manifold.

In one aspect, the length of said final stretch is substantially equal to the sum of the length of said initial stretch and N times half of said centre-to-centre distance.

In one aspect, the above "N" is an odd integer greater than or equal to 1.

In one aspect, the value of said number N is equal to 1 and the length of said final stretch is substantially equal to the sum of the length of said initial stretch and half of said centre-to-centre distance.

In one aspect, said longitudinal extension of the manifold is directed along a longitudinal axis of the manifold.

In one aspect, the second inlet/outlet end is longitudinally opposite with respect to said first inlet/outlet opening.

In one aspect, said initial stretch, said centre-to-centre distance measurement and said final stretch have respective extensions defined by dimensional values in length measured along said longitudinal axis of the manifold.

In one aspect, said axis of each branch is oriented orthogonally to said longitudinal axis of the manifold.

In one aspect, said centre-to-centre distance measurement between the branches corresponds to the distance between the respective axes of the branch of two adjacent branches (i.e. the axes of two adjacent holes).

In one aspect, considering the centre-to-centre distance measurement between the branches as a step of the manifold, i.e. a value of the distance between the branches suitable to define the manifold, the length of the final stretch is substantially equal to the length of the initial stretch plus half the step.

In one aspect, each further branch in addition to said first branch and said last branch is an internal branch, not adjacent to the first and second inlet/outlet ends, interposed between a respective previous branch (which can be the first branch or a previous internal branch) and a respective subsequent branch (which can be a subsequent internal branch or the last branch).

In one aspect, said plurality of branches comprises two branches, corresponding to said first branch and to said last branch. In one aspect, said plurality of branches comprises a number of branches greater than 2 and/or greater than 4 and/or greater than 6 and/or greater than 8 and/or greater than 10 and/or greater than 12.

In one aspect, said centre-to-centre distance measurement is constant between all the manifold branches.

In one aspect, said centre-to-centre distance measurement between the branches of the manifold is the same between the first branch and the subsequent one, between the last branch and the previous one, and—if present—between each branch and the adjacent branches (i.e. the previous branch and the subsequent branch).

In one aspect, the manifold is a single-block tubular body, extending between the first inlet/outlet end and the second inlet/outlet end and provided with all said branches.

In one aspect, the tubular body of the manifold is made of one piece.

In one aspect, the manifold, in use, is configured:

- to operate with the first inlet/outlet end that receives fluid, from the plumbing and heating system, entering the manifold and the second inlet/outlet end closed or connected to a pipe of the plumbing and heating system downstream of the manifold (in this case the first inlet/outlet end acts as the inlet end and the second inlet/outlet end acts as the outlet end);
- or to operate with the second inlet/outlet end that receives fluid, from the plumbing and heating system, entering the manifold and the first inlet/outlet end closed or connected to a pipe of the plumbing and heating system downstream of the manifold (in this case the second inlet/outlet end acts as the inlet end and the first inlet/outlet end acts as the outlet end).

In one aspect, the manifold has a linear tubular shape, for example with a circular, square or polygonal section, and the branches branch orthogonally on the external surface of said tubular shape.

In one aspect, the manifold is made starting from a metal pipe, preferably in stainless steel or brass, said metal pipe being subjected to forming and/or drilling and/or bending and/or molding and/or hydroforming operations. Alternatively, the manifold may be made of plastic material, for example by injection molding.

In one aspect, the first access or exit opening of each branch is configured to receive in connection a respective branch pipe, configured to receive a flow of fluid from the distribution conduit or to introduce a flow of fluid into the distribution conduit.

In one aspect, the overall flow rate of fluid carried by the manifold:

- is divided, at the outlet from the manifold, between the respective branch pipes of said plurality of branches in the case in which the manifold operates as a delivery manifold;
- is the sum of the flows, entering the manifold, introduced by the respective branch pipes of said plurality of branches in the case in which the manifold operates as a return manifold.

In one aspect, the first access or exit opening of each branch is defined on an external surface of the manifold.

In one aspect, all the first access or exit openings of all the branches are aligned with each other, so that the axes of all the branches are parallel to each other and all lie on the same median plane of the manifold.

In one aspect, the median plane of the manifold divides the manifold longitudinally into two halves, and crosses the first inlet/outlet end, the second inlet/outlet end and the access or exit openings of the branches.

In one aspect, said longitudinal axis of the manifold lies on the median plane of the manifold.

In one aspect, one or more of said branches, preferably all the branches, comprises a second opening, aligned with the respective first access or exit opening along the respective axis of the branch.

In one aspect, the second openings of the branches are defined on an opposite side of the external surface of the manifold with respect to the first access or exit openings.

In one aspect, the second openings are configured to allow the connection, to the respective branch, of a control device active on the respective branch.

In one aspect, the control device active on a respective branch is assembled to the second opening of the branch, crosses the inside of the distribution conduit of the manifold and acts on the first access or exit opening of the branch to control and regulate the flow of fluid exiting, or entering, the respective branch pipe.

In one aspect, said control device is:

- a flow meter/regulator, in particular when the manifold operates as a delivery manifold; or
- a thermostatic or manually operated interception valve, or an electronically controlled electrothermal head or an electrothermal actuator, in particular when the manifold operates as a return manifold.

In one aspect, said flow meter/regulator is configured to set the flow exiting the pipe of the respective branch to which it is mounted.

In one aspect, said interception valve with thermostatic option or manual operation, or said electronically controlled electrothermal head or said electrothermal actuator, are configured to open or close the passage of fluid entering, from the branch pipe, to said first access opening of the branch.

In one aspect, the aforesaid fluid is typically water, which can be either domestic hot water (DHW) or domestic cold water (AFS), and water from the heating system (to supply radiators, radiant floor elements, etc.).

In an independent aspect thereof, the present invention relates to a distribution kit comprising:

- a first manifold, according to one or more of the aspects and/or claims;
- a second manifold, according to one or more of the aspects and/or claims, preferably structurally and/or dimensionally identical or equivalent to said first manifold;
- assembly members intended to be fixed to an assembly wall on which the kit is to be positioned, and configured to receive and support the first manifold and the second manifold, such that the manifolds are stably positioned, preferably removably, with respect to the assembly members and therefore with respect to the assembly wall, and such that the first and the second manifold are vertically aligned with each other, with the first manifold above the second manifold or vice versa the second manifold above the first manifold, and preferably with the respective longitudinal axes parallel to each other;

and wherein the distribution kit is configured to allow the assembly of the first and second manifold to the assembly members at least according to one of the following assembly configurations:

- a first assembly configuration, in which the first inlet/outlet end of the first manifold is vertically aligned with the respective first inlet/outlet end of the second manifold, the second inlet/outlet end of the first manifold is vertically aligned with the respective second inlet/outlet end of the second manifold, and each branch of the first manifold has its axis coincident with the respective axis of a corresponding branch of the second manifold;
- a second assembly configuration, wherein the first inlet/outlet end of the first manifold is vertically aligned with the second inlet/outlet end of the second manifold, the second inlet/outlet end of the first manifold is vertically aligned with the first inlet/outlet end of the second manifold, and the branches of the first manifold are laterally staggered with respect to the branches of the second manifold, so that each branch of the first manifold has its own axis interposed, substantially halfway, between the respective axes of the adjacent branches of the second manifold, with the axes of the branches of the first manifold parallel to the axes of the branches of the second manifold.

In one aspect, said first manifold operates as a delivery manifold and said second manifold operates as a return manifold (or vice versa).

In one aspect, by "structurally and/or dimensionally identical or equivalent", it is meant that the two manifolds have the same tubular conformation or the same longitudinal extension, and the same measurements of the initial stretch, of the centre-to-centre distance between the branches, and of the final stretch.

In one aspect, the orientation of the second manifold with respect to the first is reversed between the first and the second assembly configuration, i.e. the second manifold is rotated by 180° (i.e. inverted) around an axis orthogonal to its longitudinal axis.

In one aspect, in both the first assembly configuration and the second assembly configuration, the distribution kit has a left side in which an inlet/outlet end (first or second) of the first manifold is vertically aligned with an inlet/outlet end (first or second) of the second manifold, and a right side—opposite to the left side with respect to the longitudinal extension of the manifolds—in which the other inlet/outlet end (second or first) of the first manifold is vertically aligned with the other inlet/outlet end (second or first) of the second manifold.

In one aspect, the assembly members comprise at least one assembly bracket provided with a rear side, intended to be fixed to an assembly wall on which the kit is to be positioned, and a front side, intended to receive and house a portion of the first manifold and a corresponding portion of the second manifold, mutually aligned vertically.

In one aspect, the assembly bracket has a prevalent longitudinal extension and can be positioned orthogonally to the longitudinal extension of the first and second manifolds.

In one aspect, the assembly bracket is provided with:

- a first tightening ring, arranged in a first position on its front side, and configured to externally wrap around a portion of the first manifold so as to make it integral with the bracket itself;
- a second tightening ring, arranged in a second position on its front side, distinct from the first position and defined below the first position, and configured to externally wrap around a portion of the second manifold so as to make it integral with the bracket itself.

In one aspect, the assembly members comprise a pair of said assembly brackets, both intended to be fixed to the assembly wall, in which:

the first assembly bracket is configured to receive a first portion of the first manifold and a corresponding first portion of the second manifold, such that they are fixed to the bracket itself, the second assembly bracket is configured to receive a second portion of the first manifold and a corresponding second portion of the second manifold, such that they are fixed to the bracket itself.

In one aspect, in the first assembly configuration:

the first portion of the first manifold, which can be mounted on the first assembly bracket, corresponds to the first inlet/outlet end of the first manifold, and the corresponding first portion of the second manifold, which can be mounted on the first assembly bracket, corresponds to the respective first inlet/outlet end of the second manifold;

the second portion of the first manifold, which can be mounted on the second assembly bracket, corresponds to the second inlet/outlet end of the first manifold, and the corresponding second portion of the second manifold, which can be mounted on the second assembly bracket, corresponds to the respective second inlet/outlet end of the second manifold.

In one aspect, in the second assembly configuration:

the first portion of the first manifold, which can be mounted on the first assembly bracket, corresponds to the first inlet/outlet end of the first manifold, and the corresponding first portion of the second manifold, which can be mounted on the first assembly bracket, corresponds to the second inlet/outlet end of the second manifold;

the second portion of the first manifold, which can be mounted on the second assembly bracket, corresponds to the second inlet/outlet end of the first manifold, and the corresponding second portion of the second manifold, which can be mounted on the second assembly bracket, corresponds to the first inlet/outlet end of the second manifold.

In one aspect, the first assembly bracket and the second assembly bracket are identical to each other and interchangeable.

In one aspect, the first assembly bracket and the second assembly bracket do not change their position or orientation whether the kit operates in the first assembly configuration or the kit operates in the second assembly configuration.

In one aspect, the kit is configured to be mounted, both in said first assembly configuration and in said second assembly configuration, in such a way that all the first access or exit openings of the branches of the first and second manifold are oriented downwards.

In one aspect, the kit comprises a plurality of branch pipes, each branching off from a respective branch of the first or second manifold.

In one aspect:

in the first configuration, the pipes of the branches of the first manifold are aligned and substantially coaxial with respect to the corresponding pipes of the second manifold; the pipes of the second manifold pass behind the first manifold (or vice versa), between the rear surface of the first manifold and an assembly wall on which the kit can be positioned or is positioned;

in the second configuration, the pipes of the branches of the first manifold are laterally, and in parallel, staggered with respect to the pipes of the second manifold; the pipes of the second manifold pass behind the first manifold (or vice versa), between the rear surface of the first manifold and an assembly wall on which the kit can be positioned or is positioned, in such a way as to be alternated, or interleaved, with respect to the pipes of the first manifold.

In one aspect, the branches of the first manifold (if operating as a delivery manifold) are provided with respective second openings, and the kit comprises a plurality of flow meters/regulators, each mountable to the second opening of a respective branch and configured to set the flow rate exiting the pipe of said respective branch.

In one aspect, the branches of the second manifold (if operating as a return manifold) are provided with respective second openings, and the kit comprises a plurality of interception valves, each mountable to the second opening of a respective branch and configured to open or close the passage of fluid entering the pipe of said respective branch.

In an independent aspect thereof, the present invention relates to a mixing system comprising at least one kit according to one or more of the aspects and/or claims, which can be assembled in one of said first or second assembly configurations, and further comprising a plurality of components among which conduits, valves and/or one or more pumps, implementing at least one delivery branch and one return branch of the mixing system, in which:

with the kit in said first assembly configuration, at least the first inlet/outlet end of the first manifold is placed in fluid communication with said delivery branch of the mixing system, to receive therefrom the fluid entering the distribution conduit of the first manifold, and at least the first inlet/outlet end of the second manifold is placed in fluid communication with said return branch of the mixing system, to send thereto fluid exiting the distribution conduit of the second manifold; or with the kit in said second assembly configuration, at least the first inlet/outlet end of the first manifold is placed in fluid communication with said delivery branch of the mixing system, to receive therefrom the fluid entering the distribution conduit of the first manifold, and at least the second inlet/outlet end of the second manifold is placed in fluid communication with said return branch of the mixing system, to send thereto fluid exiting the distribution conduit of the second manifold.

In an independent aspect thereof, the present invention relates to a method for assembling a distribution kit, comprising the steps of:

providing a first manifold, according to one or more of the aspects and/or claims;

providing a second manifold, according to one or more of the aspects and/or claims, preferably structurally and/or dimensionally identical or equivalent to said first manifold;

providing assembly members intended to be fixed to an assembly wall on which the kit is to be positioned, and configured to receive and support the first manifold and the second manifold, such that the manifolds are stably positioned, preferably removably, with respect to the assembly members and therefore with respect to the assembly wall, assembling the first manifold and the second manifold to the assembly members, such that the two manifolds are vertically aligned with each other, with the first manifold above the second manifold or vice versa the second manifold above the first manifold, and preferably with the respective longitudinal axes parallel to each other;

wherein said step of assembling the first manifold and the second manifold to the assembly members can take place according to at least one of the following assembly configurations:

- a first assembly configuration, in which the first inlet/outlet end of the first manifold is vertically aligned with the respective first inlet/outlet end of the second manifold, the second inlet/outlet end of the first manifold is vertically aligned with the respective second inlet/outlet end of the second manifold, and each branch of the first manifold has its axis coincident with the respective axis of a corresponding branch of the second manifold;
- a second assembly configuration, wherein the first inlet/outlet end of the first manifold is vertically aligned with the second inlet/outlet end of the second manifold, the second inlet/outlet end of the first manifold is vertically aligned with the first inlet/outlet end of the second manifold, and the branches of the first manifold are laterally staggered with respect to the branches of the second manifold, so that each branch of the first manifold has its own axis interposed, substantially halfway, between the respective axes of the adjacent branches of the second manifold, with the axes of the branches of the first manifold parallel to the axes of the branches of the second manifold.

In an independent aspect thereof, the present invention relates to a method for assembling a mixing system, comprising the steps of:

- providing at least one kit according to one or more of the aspects and/or claims, which can be assembled in one of said first or second assembly configuration;
- providing a plurality of components among which pipes, valves and/or one or more pumps, forming at least a delivery branch and a return branch of the mixing system;
- selecting one of said first assembly configuration and second assembly configuration and performing the assembly of the first manifold and of the second manifold to the assembly members;

wherein the method further comprises one of the following steps, depending on the selected assembly configuration:

- if the first assembly configuration for the kit is selected, placing at least the first inlet/outlet end of the first manifold in fluid communication with said delivery branch of the mixing system to receive therefrom the fluid entering the distribution conduit of the first manifold, and provided at least the first inlet/outlet end of the second manifold in fluid communication with said return branch of the mixing system to send thereto fluid exiting the distribution conduit of the second manifold;
- if the second assembly configuration for the kit is selected, placing at least the first inlet/outlet end of the first manifold n fluid communication with said delivery branch of the mixing system to receive therefrom the fluid entering the distribution conduit of the first manifold, and placing at least the second inlet/outlet end of the second manifold in fluid communication with said return branch of the mixing system to send thereto fluid exiting the distribution conduit of the second manifold.

Each of the above aspects of the invention can be taken alone or in combination with any of the claims or other aspects described.

Further features and advantages will become apparent from the detailed description of some exemplary but non-exclusive embodiments, including also a preferred embodiment, of a manifold for the distribution of a fluid, a distribution kit for plumbing and heating systems, a mixing system and a method for assembling a distribution kit or a mixing system for plumbing and heating systems according to the present invention. Such description is given hereinafter with reference to the accompanying drawings, provided only for illustrative and, therefore, non-limiting purposes, in which.

Figure 1:
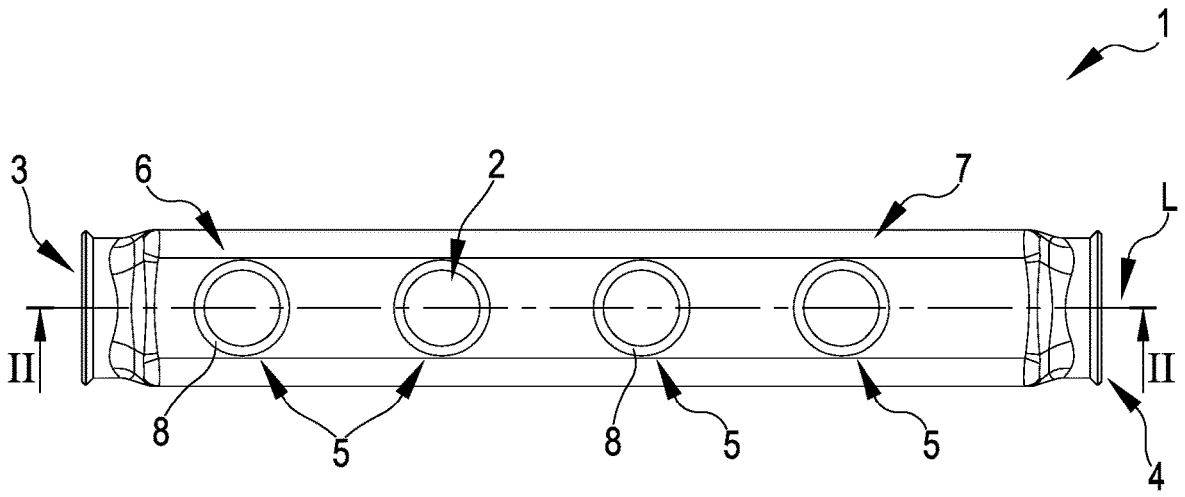
FIG. 1 shows a top plan view of a possible embodiment of a manifold for distributing a fluid in a plumbing and heating system according to the present invention.

With reference to the cited figures, reference numeral 1 indicates as a whole a manifold for the distribution of a fluid circulating in a plumbing and heating system, according to the present invention. Reference numeral 50 generally indicates a distribution kit according to the present invention. In general, the same reference numeral is used for identical or similar elements, possibly in their embodiment variants.

The entire mixing system made starting from a manifold 1 and a distribution kit 50 is not shown, and its components (valves, pumps, conduits, etc.) associated with the manifold 1 and the kit 50 can be of a known type.

The entire plumbing and heating system which uses the mixing system, as well as the manifold 1 and the kit 50, according to the present invention is not shown, since it is of a per se known type.

Figure 2:
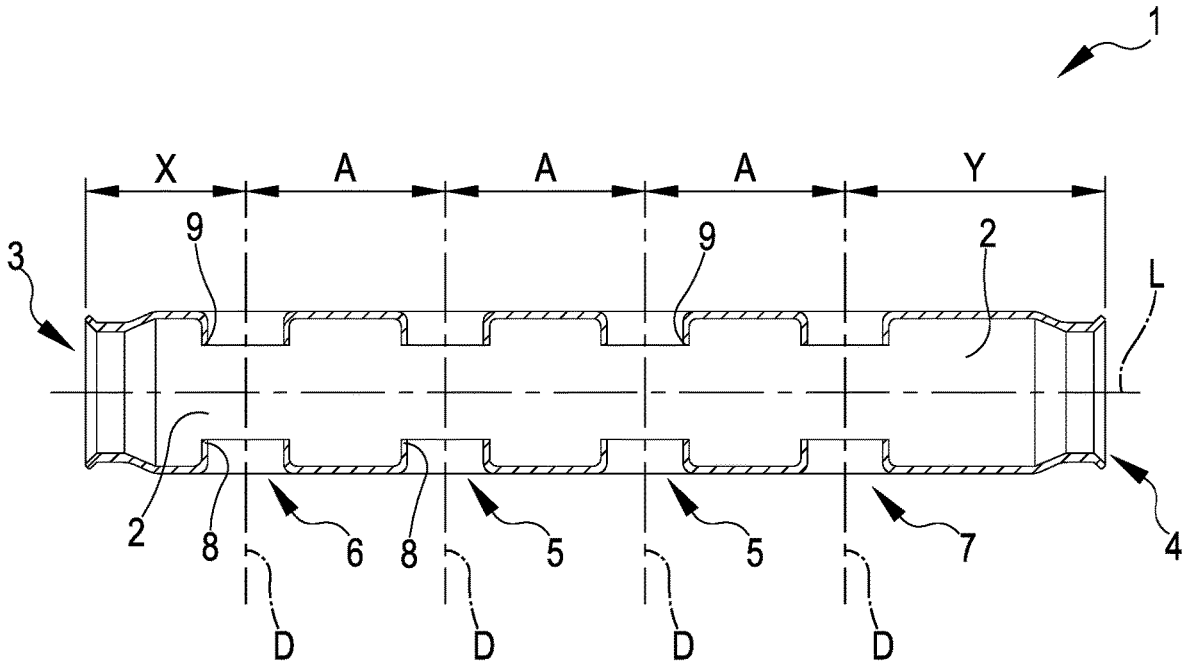
FIG. 2 shows a longitudinal section view, along the plane II-II, of the manifold of FIG. 1.

As shown in all the figures, and in particular in FIGS. 1 and 2, the manifold 1 overall has a tubular shape, which defines in its interior a distribution conduit 2 intended to be crossed by a fluid (for example water from a plumbing and heating system).

The manifold 1 extends longitudinally between:

- a first inlet/outlet end 3, which puts the distribution conduit 2 in communication with the exterior of the manifold and is configured (based on the operating conditions, illustrated below) to receive fluid entering the manifold or to send fluid exiting the manifold;
- a second inlet/outlet end 4, separate from the first inlet/outlet end, which puts the distribution conduit 2 in communication with the exterior of the manifold and is configured to receive fluid entering the manifold or to send fluid exiting the manifold.

The manifold 1, in use, is configured to operate with at least one of the first end 3 and the second end 4 which receives fluid entering the manifold or which sends fluid exiting the manifold.

The manifold is provided with a plurality of branches 5, mutually distinct and arranged in series along the longitudinal extension of the manifold (indicated with L in the figures), interposed between the first inlet/outlet end 3 and the second inlet/outlet end 4.

In the figures, the manifolds 1 are shown by way of example with four branches 5, identical to each other and equidistant from each other along the longitudinal extension L. As illustrated below, the manifold 1 according to the present invention may have any number of branches, preferably from a minimum of two branches up (up to ten or twenty branches).

As illustrated in the figures, the plurality of branches 5 preferably comprises at least a first branch 6 and a final branch 7.

The first branch 6 is the branch located closest to the first inlet/outlet end 3 (and therefore further away from the second inlet/outlet end 4). The last branch 7 is the branch located closest to the second inlet/outlet end 4 (and therefore further away from the first inlet/outlet end 3).

Each branch of the aforesaid plurality of branches 5 defines a respective "branch point" of the manifold, also referred to in jargon as "detachment" or "way", at which a quantity of fluid in transit in the distribution conduit 2 can exit the distribution conduit towards the exterior or a quantity of fluid coming from the exterior can enter the distribution conduit 2.

Each branch 5 comprises at least one respective first access or exit opening 8, configured to allow at least part of the fluid in transit in the distribution conduit 2 to exit the manifold (in the case in which the manifold operates in fluid delivery) or the inlet of fluid inside the distribution conduit 2 (in the case in which the manifold operates in fluid return).

Preferably, the respective first access or exit opening 8 is a hole having a respective axis of the branch D.

The branches 5 of the aforesaid plurality of branches are positioned, in the manifold 1, in such a way that:

- the distance between the first inlet/outlet end 3 and the axis D of the first branch 6 is equal to an "initial stretch" (indicated with X) of the manifold;
- the distance between the axis D of each branch and the axis D of two adjacent branches is equal to a certain centre-to-centre distance measurement between the branches 5 of the manifold (indicated with A);
- the distance between the axis D of the last branch 7 and the second inlet/outlet end 4 is equal to a "final stretch" (indicated with Y) of the manifold.

According to the present invention, the length of the aforementioned final stretch Y is substantially equal to the sum of the length of the initial stretch X and "N times" half of the centre-to-centre distance measurement A. Moreover, the aforesaid value "N" is an odd integer greater than or equal to 1.

Preferably, as in the embodiment shown in the figures, the value of said number "N" is equal to 1 and the length of the final stretch Y is equal to the sum of the length of the initial stretch X and half of the centre-to-centre distance measurement A.

By translating this concept into a mathematical formula, it is obtained that the overall length of an entire manifold 1 according to the present invention is equal to:

$$X+[(n-1)*A]+Y$$

where Y=[X+(N*A/2)]

and where "n" is the number of branches.

Basically, the manifold is defined in stretches, starting from the initial stretch X, continuing with many stretches corresponding to the succession of all the branches (separated from each other by a centre-to-centre distance A) and ending with the final stretch Y.

In practice, the longitudinal length of the manifold 1 is defined as the sum of the following succession of values:

X, A, A, . . . , A, A, Y where the number of "A" (i.e. centre-to-centre distances) in the succession is equal to the number of branches "n"−1. In fact, as can be seen in the figures, if the branches are four, the centre-to-centre distances "A" are three (those included between two adjacent branches), while the lengths external to the first branch 5 and to the last branch 6 constitute the initial stretch X and the final stretch Y.

It should be noted that, as in the embodiment of the figures, the value Y is equal to X+A/2, since the value of N is exactly equal to 1: in practice, the final stretch is equal to the initial stretch plus half the centre-to-centre distance. According to the present invention, N can also be equal to a higher odd number, for example 3, 5, etc. It should also be noted that the centre-to-centre distance measurement A, i.e. the distance between the D axis of each branch and the axes D of the "adjacent" branches, is valid both for the "internal" branches of the manifold, that is, which have two adjacent branches (one before and one after along the longitudinal extension L), and for the first 6 and the last branch 7. In fact, the distance between the axis of the first branch 6 and the axis of the subsequent branch (the second) and the distance between the axis of the last branch 7 and the axis of the previous branch (the penultimate), are also equal to the centre-to-centre distance measurement A. In general, the centre-to-centre distance measurement A is repeated among all branches 5, based on the number of branches of the manifold 1.

Preferably, the longitudinal extension L of the manifold 1 is directed along a longitudinal axis of the manifold (also indicated with L in the figures).

Preferably, the second inlet/outlet end 4 is longitudinally opposite with respect to the first inlet/outlet opening 3. Within the scope of the present invention, and as shown in the figures, the initial stretch X, the centre-to-centre distance measurement A and the final stretch Y have respective extensions defined by dimensional values in length measured along the longitudinal axis L of the manifold.

Preferably, the axis D of each branch 5 is oriented orthogonally to the longitudinal axis L of the manifold 1.

Preferably, the centre-to-centre distance measurement A between the branches 5 corresponds to the distance between the respective axes of the branch D of two adjacent branches (i.e. the axes of two adjacent holes defining the first access or exit openings 8). The distances defined in the formulas are generally calculated with respect to the axes D of the holes of the branches 5.

Basically, the initial stretch X extends from the first inlet/outlet end 3 (i.e. from the beginning of the manifold) to the axis D of the first branch 6, and the final stretch Y extends from the axis D of the last branch 7 to the second inlet/outlet end 4 (i.e. up to the end of the manifold).

Preferably, the initial stretch X constitutes a tubular portion of the manifold 1 devoid of further branches except for half of the first branch 6, X being measured from the first end 3 to the axis D of the first branch 6. Typically, the initial stretch X is substantially a connecting part for the connection, in use, of the end 3 to a destination part, and has a length such as to be able to house, for example, a thread.

Preferably, the final stretch Y constitutes a tubular portion of the manifold 1 devoid of further branches except for half of the last branch 7, Y being measured from the axis D of the last branch 7 to the second end 4.

Preferably, considering the centre-to-centre distance measurement A between the branches 5 as a "step" of the manifold (which constitutes a technical specification thereof), i.e. a value of the distance between the branches 5 suitable to define the manifold, the length of the final stretch Y is substantially equal to the length of the initial stretch X plus half the step. In other words, the manifold 1 is, on the one hand, half a step longer (or half the centre-to-centre distance A/2) than it is on the opposite side, considering these sides as the two ends (3 and 4)—along the longitudinal extension L—placed externally to the plurality of branches 5.

Preferably, the further branches 5 of the plurality of branches, in addition to the first branch 6 and the last branch 7, are positioned in sequence between the first branch and the last branch.

Preferably, each further branch in addition to the first branch 6 and the last branch 7 is an "internal" branch, not adjacent or contiguous to the first 3 and second 4 inlet/outlet ends, interposed between a respective previous branch (which can be the first branch or a previous internal branch) and a respective subsequent branch (which can be a subsequent internal branch or the last branch).

In a possible embodiment (not shown), the plurality of branches may comprise two branches, corresponding to the first branch and the last branch.

Preferably, the plurality of branches comprises a number of branches 5 greater than 2 or greater than 4 or greater than 6 or greater than 8 or greater than 10 or greater than 12. The number of branches may be selected on the basis of the destination system of the manifold, without affecting the general technical solution underlying the present invention.

Preferably, as in the example shown in the figures, the centre-to-centre distance measurement A is constant between all the branches 5 of the manifold 1.

Preferably, as in the example shown in the figures, all the branches 5 of the manifold are identical to each other (for example they are branches suitable for receiving a pipe with a diameter of 16 mm, or 20 mm, or 26 mm, etc.).

Preferably, the centre-to-centre distance measurement A between the branches of the manifold is the same between the first branch 6 and the subsequent one, between the last branch 7 and the previous one, and—if further branches are present in addition to the two end ones—between each branch and the adjacent branches (i.e. the previous branch and the subsequent branch).

Preferably, the manifold 1 has a rectilinear tubular shape (i.e. the longitudinal axis L lies on a straight line), as shown in the figures. In any case, the manifold may also have a curvilinear shape, but in any case extending in a longitudinal direction, and also in this case the measurements of X, A, Y are calculated along the longitudinal extension L.

Preferably, the manifold 1 is a single-block tubular body which extends between the first inlet/outlet end 3 and the second inlet/outlet end 4 and provided with all said branches.

Preferably, the tubular body of the manifold 1 is made of one piece.

In a possible alternative embodiment, not shown, the tubular body of the manifold may comprise a main body, comprising the first inlet/outlet end and the plurality of branches, and a final portion defining at least partially the final stretch Y, comprising the second inlet/outlet ends; in this case, the final portion is associated with the main body to form a unitary manifold. Preferably, the final portion may have an extension equal to the length of the final stretch or equal to the length of the initial stretch or equal to the length of half of the centre-to-centre distance measurement (or N times the half of the centre-to-centre distance measurement). Preferably, the final portion may be a threaded nipple or an extension.

Preferably, as shown by way of example in the figures, the first inlet/outlet end 3 and the second inlet/outlet end 4 are open towards the exterior of the manifold 1.

In a possible alternative embodiment, not shown, one of said first and second inlet/outlet ends may be closed by means of closing means. Preferably, such closing means comprise a closing element made of one piece with the aforesaid tubular body, for example a molded or folded or welded wall thereof which closes the inlet/outlet opening. Alternatively, the closing means may comprise an additional closing element configured to be removably associated with the inlet/outlet opening to determine the closure thereof. This additional closing element may be for example a plug (for example a threaded plug) or a tap or a vent or a pressure gauge.

Typically, with manifold 1 mounted in a mixing system, one of the two inlet/outlet ends (the one not connected to the delivery branch or the return branch of the system) is then closed, precisely, with a plug, a vent, a pressure gauge or a tap.

For example, a typical installation that can be carried out by an expert in the field provides that one end of the manifold receives fluid from the system and distributes it among the branches, and the other end is then closed, or the manifold receives fluid from the branches and sends it to the system via one end, while the other is closed.

Preferably, the manifold 1, used as a delivery manifold, is configured:

- to operate with the first inlet/outlet end 3 that receives fluid, from the plumbing and heating system, entering the manifold 1 and the second inlet/outlet end 4 closed or connected to a pipe of the plumbing and heating system downstream of the manifold (in this case the first inlet/outlet end acts as the inlet end and the second inlet/outlet end acts as the outlet or closing end);
- to operate with the second inlet/outlet end 4 that receives fluid, from the plumbing and heating system, entering the manifold 1 and the first inlet/outlet end 3 closed or connected to a pipe of the plumbing and heating system downstream of the manifold (in this case the second inlet/outlet end acts as the inlet end and the first inlet/outlet end acts as the outlet or closing end).

Preferably, the manifold 1 has a linear tubular shape, for example with a circular, square or polygonal section, and the branches 5 branch orthogonally on the external surface of such a tubular shape.

Preferably, the manifold is made starting from a metal pipe, preferably in stainless steel or brass (for example yellow brass CW617N), said metal pipe being subjected to forming and/or drilling and/or bending and/or molding and/or hydroforming operations. For example, the manifold is made by means of a steel pipe having a thickness of about 1 mm, or comprised between 0.5 mm and 3 mm. Alternatively, the manifold may be made of plastic material (for example of PPSU technopolymer), for example by injection molding.

Preferably, the first access or exit opening 8 of each branch 5 is configured to receive in connection a respective branch pipe 30, configured to receive a flow of fluid from the distribution conduit or to introduce a flow of fluid into the distribution conduit.

Preferably, the overall flow rate of fluid carried by the manifold 1:

is divided, at the outlet from the manifold, between the respective branch pipes 30 of the plurality of branches 5 in the case in which the manifold operates as a delivery manifold;

is the sum of the flows, entering the manifold, introduced by the respective branch pipes 30 of the plurality of branches 5 in the case in which the manifold operates as a return manifold.

Basically, the manifold 1 distributes, preferably in a controlled manner, the fluid transported by it among the various branches 5, in the case in which it is operating as a delivery manifold, while it receives, preferably in a controlled manner, the flows entering all the branches 5, if it is operating as a return manifold.

Preferably, the first access or exit opening 8 of each branch 5 comprises respective connection means, for example a threaded connection for installing the respective branch pipe 30.

Preferably, the first inlet/outlet end 3 and/or the second inlet/outlet end 4 comprise respective means for connection to a part, upstream or downstream, of the plumbing and heating system to receive fluid entering the manifold or to send fluid exiting the manifold. Such a part of the system may be a delivery pipe from the boiler, a return pipe to the boiler, an inlet to a pump, an outlet from a pump, an inlet to a valve device, an outlet from a valve device. Preferably, the connection means may comprise a threaded portion intended to connect to a corresponding counter-thread of said part of the plumbing and heating system.

Preferably, the first access or exit opening 8 of each branch 5 is defined on an external surface of the manifold 1 (and communicates with the interior of the distribution conduit 2, i.e. it passes through the tubular body).

Preferably, all the first access or exit openings 8 of all the branches 5 are aligned with each other, so that the axes D of all the branches 5 are parallel to each other and all lie on the same median plane of the manifold (corresponding to the section plane II-II indicated in FIG. 1).

Preferably, the median plane of the manifold divides the manifold 1 longitudinally into two halves, and crosses the first inlet/outlet end 3, the second inlet/outlet end 4 and the access or exit openings 8 of the branches 5.

Preferably, the longitudinal axis L of the manifold lies on the median plane of the manifold.

Preferably, one or more of the branches 5, preferably all the branches, comprises a second opening 9, preferably aligned with the respective first access or exit opening 8 along the respective axis D of the branch.

Preferably, the second openings 9 of the branches 5 are defined on an opposite side of the external surface of the manifold with respect to the first access or exit openings 8.

Preferably, the second openings 9 are configured to allow the connection, to the respective branch 5, of a control device 20 active on the respective branch 5.

Preferably, the control device 20 active on a respective branch 5 is assembled to the second opening 9 of the branch, crosses the inside of the distribution conduit 2 of the manifold and acts on the first access or exit opening 8 of the branch 5 to control and regulate the flow of fluid exiting, or entering, the respective branch pipe 30.

Preferably, the control device is:

a flow meter/regulator 21, when the manifold operates as a delivery manifold; or a thermostatic or manually operated interception valve 22, or an electronically controlled electrothermal head or an electrothermal actuator, when the manifold operates as a return manifold.

Preferably, the flow meter/regulator 21 is configured to set the flow rate exiting, through the first outlet opening 8 of the branch, from the pipe 30 of the respective branch 5 to which it is mounted.

Preferably, the interception valve 22 with thermostatic option or manual operation, or the electronically controlled electrothermal head or the electrothermal actuator, are configured to open or close the passage of fluid entering, from the branch pipe 30, to the first access opening 8 of the branch.

A distribution kit 50 according the present invention is now described, illustrated by way of example in FIGS. 3-8.

The kit 50 includes first of all:

a first manifold 1;

a second manifold 10, preferably structurally and dimensionally identical or equivalent to the first manifold 1;

assembly members 60.

In FIGS. 3-8, the distribution kit 50 comprises two manifolds 1 and 10 which are completely identical to each other, as an advantageous application of the technical solution underlying the present invention. It should also be noted that the two manifolds 1 and 10 of FIGS. 3-8 are identical to the manifold 1 illustrated in FIGS. 1-2, and include the same technical features described above.

The assembly members 60 are intended to be fixed to an assembly wall (not shown, for example a wall or the inside of a plumbing box) on which the kit is to be positioned, and are configured to receive and support the first manifold 1 and the second manifold 10, such that the manifolds 1 and 10 are stably positioned, preferably removably, with respect to the assembly members and therefore with respect to the assembly wall.

The assembly of the manifolds to the assembly members 60 is made so that the first 1 and the second manifold 10 are vertically aligned with each other, with the first manifold above the second manifold or vice versa (as shown in the figures) with the second manifold 10 above the first manifold 1, and preferably with the respective longitudinal axes L parallel to each other.

The distribution kit 50 is configured to allow the assembly of the first 1 and second manifold 10 to the assembly members 60 at least according to one of the following assembly configurations:

a first assembly configuration, in which the first inlet/outlet end 3 of the first manifold 1 is vertically aligned with the respective first inlet/outlet end 13 of the second manifold 10, the second inlet/outlet end 4 of the first manifold 1 is vertically aligned with the respective second inlet/outlet end 14 of the second manifold 10, and each branch 5 of the first manifold has its axis D coincident with the respective axis D' of a corresponding branch 15 of the second manifold 10 (placed above the first manifold);

a second assembly configuration, in which the first inlet/outlet end 3 of the first manifold 1 is vertically aligned with the second inlet/outlet end 14 of the second manifold 10, the second inlet/outlet end 4 of the first manifold 1 is vertically aligned with the first inlet/outlet end 13 of the second manifold 10, and the branches 5 of the first manifold 1 are laterally staggered with respect to the branches 15 of the second manifold 10 (placed above the first manifold), so that each branch 5 of the first manifold 1 has its axis D interposed, substantially halfway, between the respective axes D' of the overlying adjacent branches 15 of the second manifold 1'0, with the axes D of the branches of the first manifold 1 parallel to the axes D' of the branches 15 of the second manifold.

Figure 3:
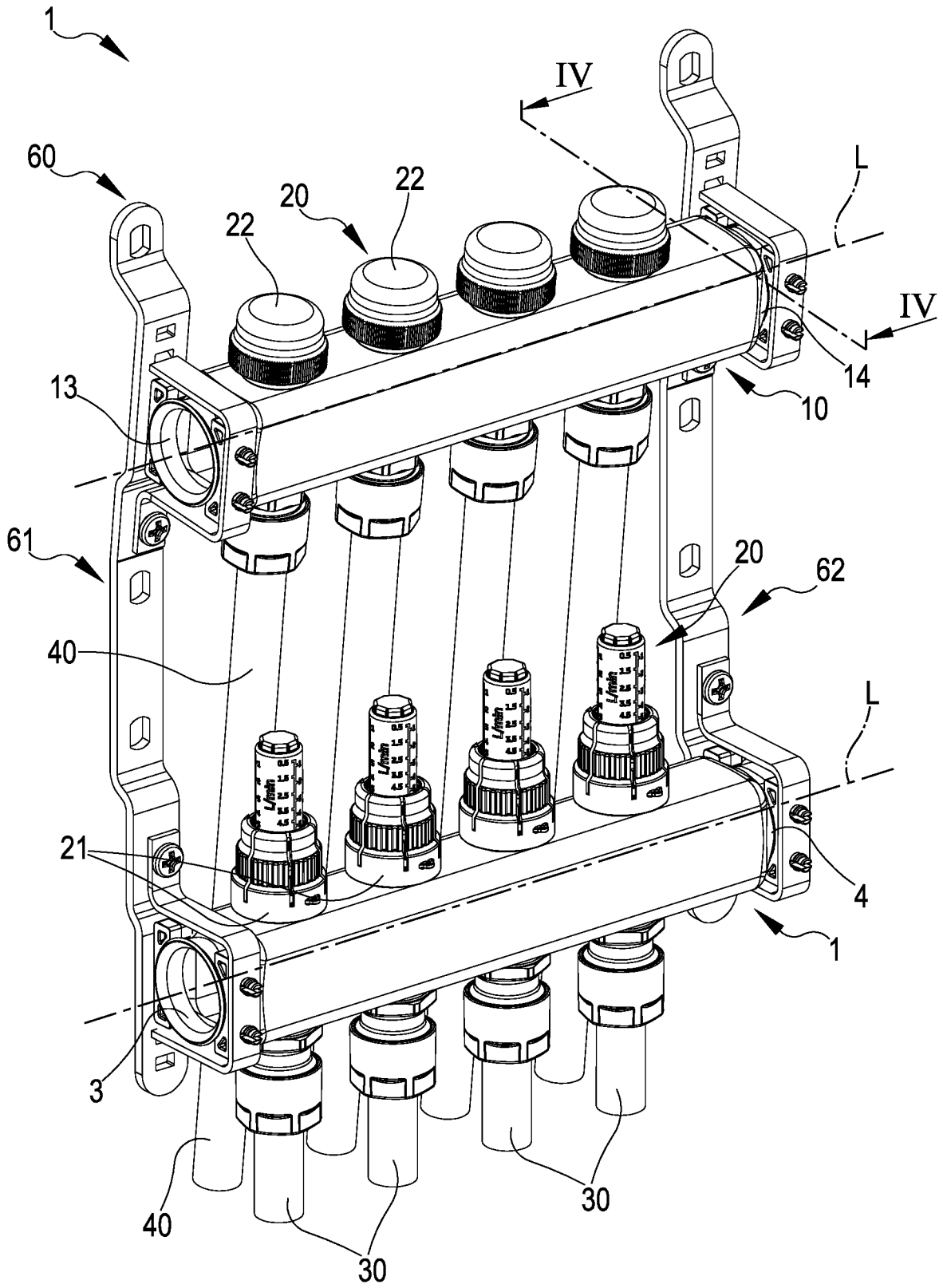
FIG. 3 shows a perspective view of a possible embodiment of a distribution kit for a mixing system of a plumbing and heating system, according to the present invention, in a first assembly configuration, with some parts removed and some accessories.
Figure 4:
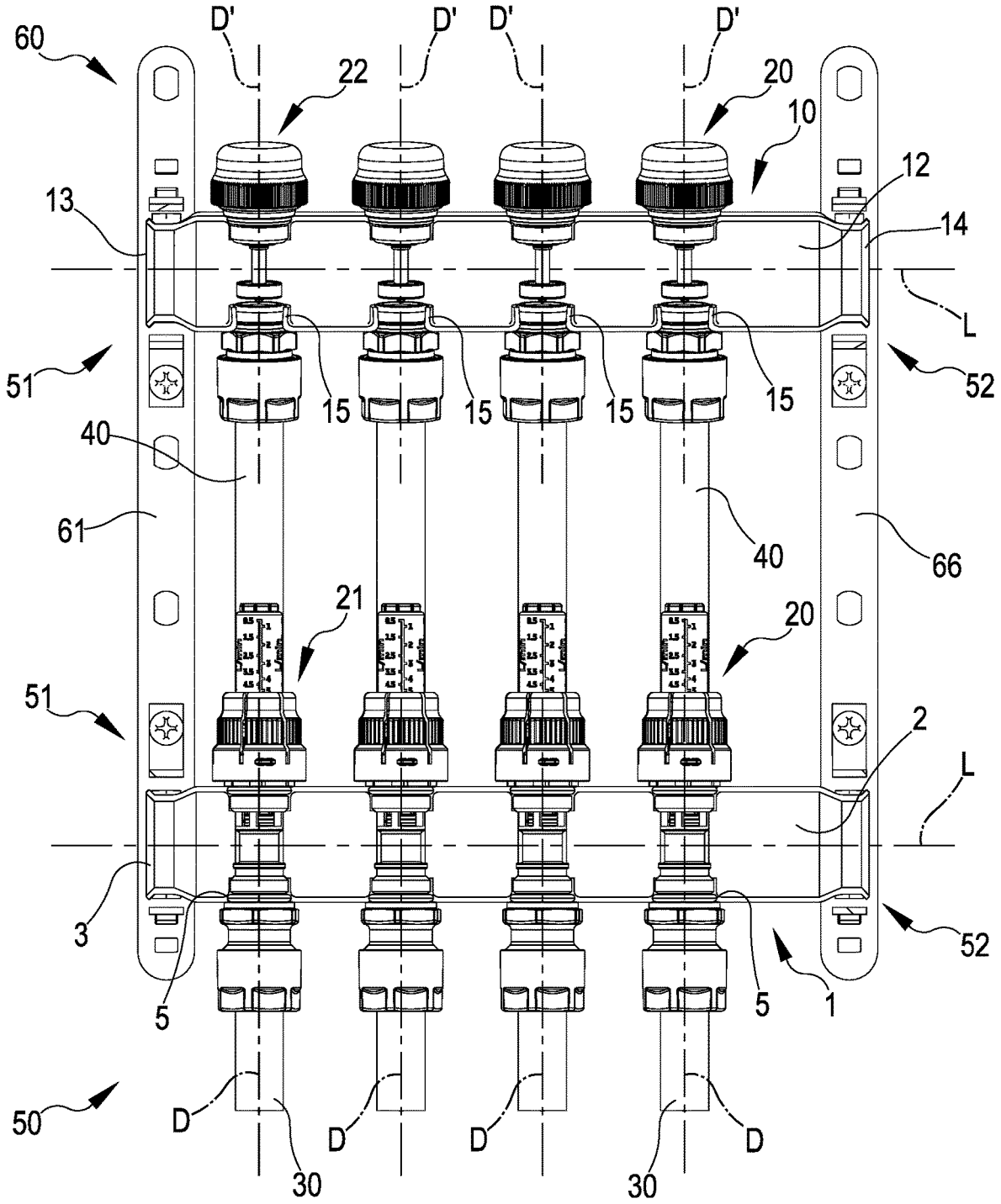
FIG. 4 shows a front view, and in partial section along the plane IV-IV, of the distribution kit of FIG. 3.
Figure 5:
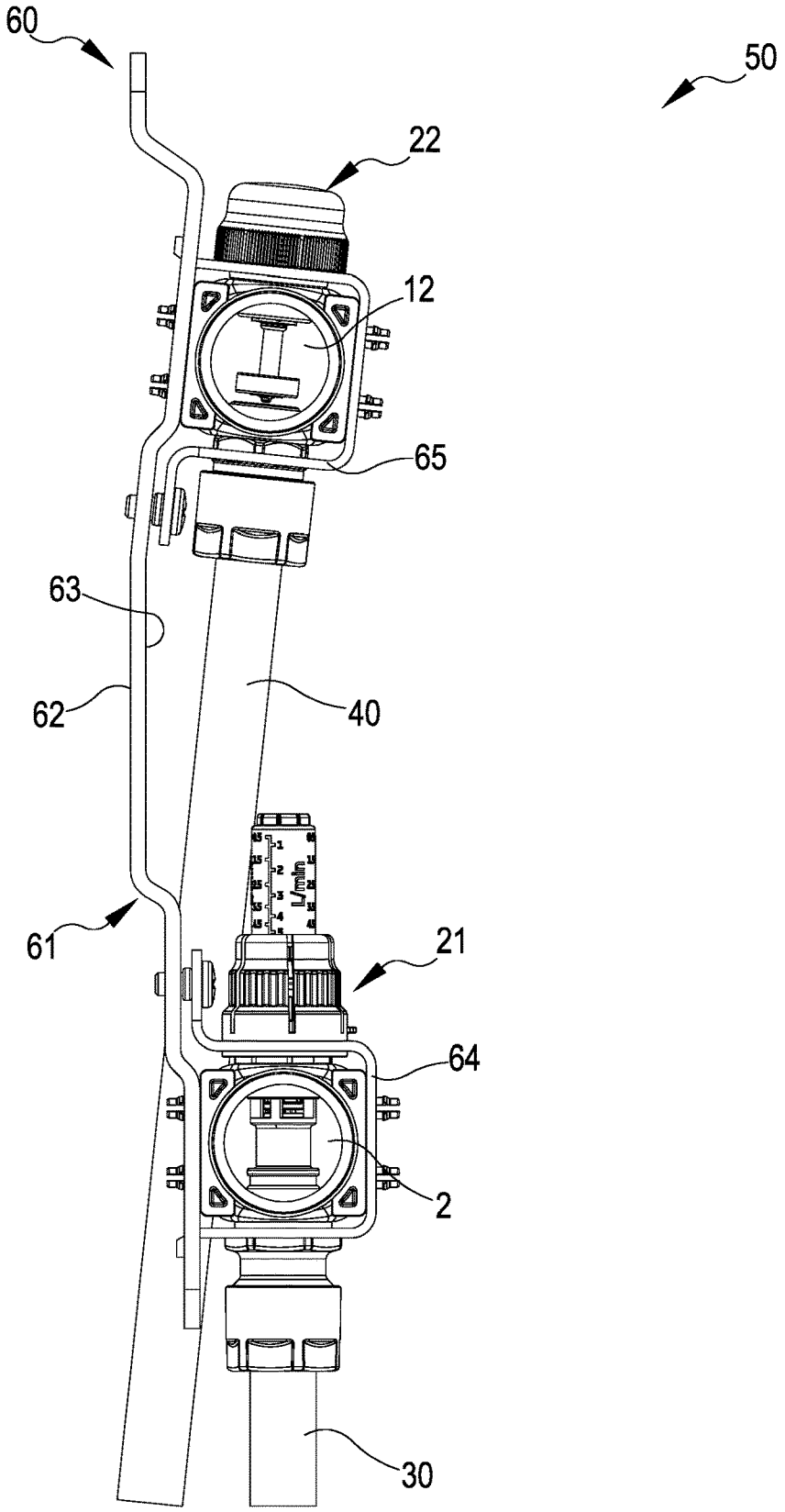
FIG. 5 shows a side view of the distribution kit of FIGS. 3 and 4.
Figure 6:
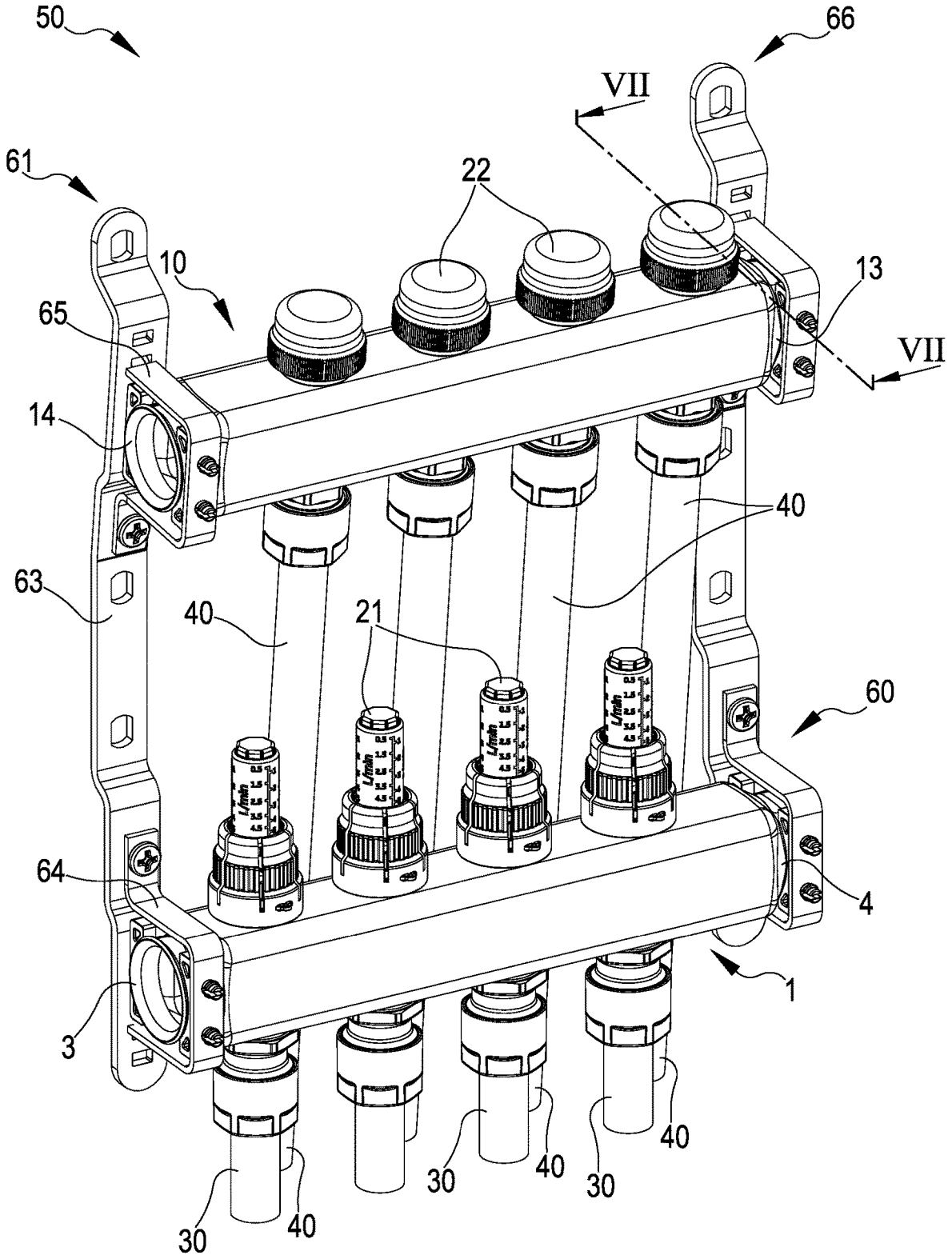
FIG. 6 shows a perspective view of a possible embodiment of a distribution kit for a mixing system of a plumbing and heating system, according to the present invention, in a second assembly configuration, with some parts removed and some accessories.
Figure 7:
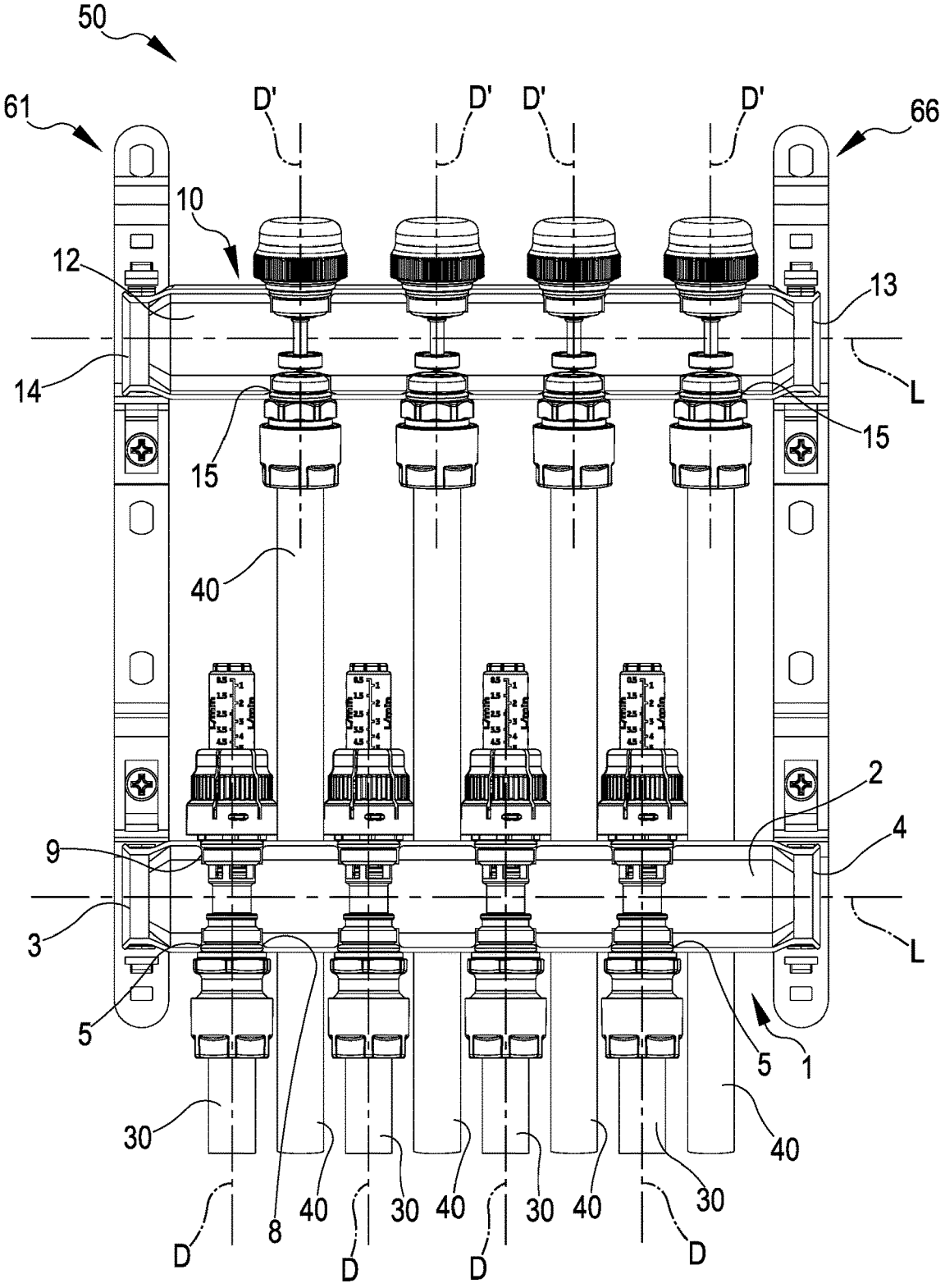
FIG. 7 shows a front view, and in partial section along the plane VII-VII, of the distribution kit of FIG. 6.
Figure 8:
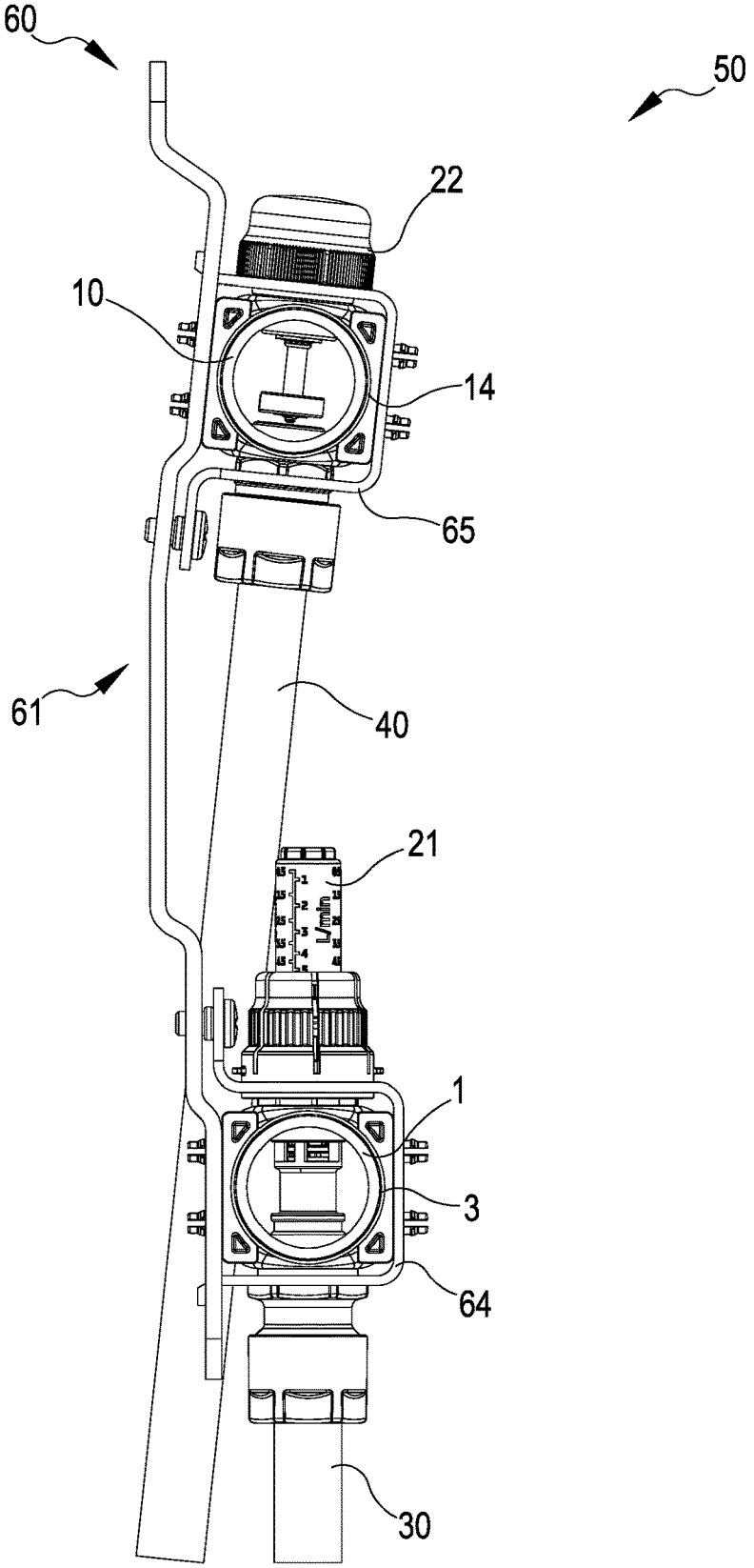
FIG. 8 shows a side view of the distribution kit of FIGS. 6 and 7.

It should be noted that the "first assembly configuration" is exemplarily shown in FIGS. 3, 4 and 5, while the "second assembly configuration" is exemplary shown in FIGS. 6, 7 and 8.

Preferably (as shown in FIGS. 3-8), the first manifold 1 operates as a delivery manifold and the second manifold 10 operates as a return manifold (but the kit works in the same way in reverse, i.e. with reversed manifolds).

By the expression "structurally and/or dimensionally identical or equivalent", it is meant that the two manifolds 1 and 10 have the same tubular conformation and/or the same longitudinal extension, and the same measurements of the initial stretch X, of the centre-to-centre distance A between the branches, and of the final stretch Y.

Preferably, the orientation of the second manifold 10 with respect to the first manifold 1 is reversed between the first and the second assembly configuration, i.e. the second manifold is rotated by 180° (i.e. inverted) around an axis orthogonal to its longitudinal axis L.

In the context of this description, the use of terms such as "vertical", "vertically", "above", "upper", "superiorly", "below", "lower", "inferiorly", "side", "laterally", "horizontal", "horizontally", "front", "rear", and the like refers, unless otherwise specified, to the spatial orientation that the object of the invention normally assumes in operating and use conditions. In this regard, consider that distribution kits and mixing systems are typically installed—as shown in the accompanying figures—vertically, on a wall or a vertical wall (often inside a special box).

It should be noted that, in the context of the present invention, the term "kit" means an equipment, a set of components (in this case at least the first and second manifolds and the assembly members). The kit 50 is defined as such both in the disassembled condition (for example with the components contained in a package, intended for sale or at a place of use), and in the assembled condition (i.e. the kit installed on site, in a plumbing and heating system).

In the first assembly configuration, the respective first inlet/outlet ends 3 and 13 of the first 1 and of the second manifold 10 are vertically aligned on the same side of the kit (for example the left side in FIGS. 3 and 4) and the respective second ends inlet/outlet ends 4 and 14 of the first 1 and of the second manifold 10 are vertically aligned on an opposite side of the kit (for example the right side in FIGS. 3 and 4).

In the second assembly configuration, the first inlet/outlet end 3 of the first manifold 1 and the second inlet/outlet end 14 of the second manifold 10 are vertically aligned on the same side of the kit (for example the left side in FIGS. 6 and 7) and the second inlet/outlet end 4 of the first manifold 1 and the first inlet/outlet end 13 of the second manifold 10 are vertically aligned on an opposite side of the kit (for example the right side in FIGS. 6 and 7).

Preferably, in both the first assembly configuration and the second assembly configuration, the distribution kit 50 has a left side in which an inlet/outlet end (first 3 or second 4) of the first manifold 1 is vertically aligned with an inlet/outlet end (first 13 or second 14) of the second manifold 10, and a right side—opposite to the left side with respect to the longitudinal extension L of the manifolds—in which the other inlet/outlet end (second 4 or first 3) of the first manifold 1 is vertically aligned with the other inlet/outlet end (second 14 or first 13) of the second manifold 10.

Preferably, the assembly members 60 comprise at least one assembly bracket 61 provided with a rear side 62, intended to be fixed to the assembly wall on which the kit 50 is to be positioned, and a front side 63, intended to receive and house a portion of the first manifold and a corresponding portion of the second manifold, mutually aligned vertically.

Preferably, the assembly bracket 61 has a prevalent longitudinal extension and can be positioned orthogonally to the longitudinal extension L of the first 1 and second manifolds 10.

Preferably, the assembly bracket 61 is provided with:

- a first tightening ring 64, arranged in a first position on its front side 63, and configured to externally wrap around a portion of the first manifold 1 so as to make it integral with the assembly bracket 61 itself;
- a second tightening ring 65, arranged in a second position on its front side 63, distinct from the first position and defined below the first position, and configured to externally wrap around a portion of the second manifold 10 so as to make it integral with the assembly bracket 61 itself.

In the exemplary embodiment shown in FIGS. 3-8, the two tightening rings 64 and 65 of each bracket are made as clamps which can be selectively tightened to the front side of the bracket by means of suitable screws, which allow the clamp to be loosened or tightened to insert and fix the tubular body of the manifold. The tightening rings can be replaced with equivalent mechanical means.

Preferably, as shown by way of example in FIGS. 3-8, the assembly members 60 comprise a pair of assembly brackets 61 and 66, both intended to be fixed to the assembly wall, in which:

- the first assembly bracket 61 is configured to receive a first portion of the first manifold 1 and a corresponding first portion of the second manifold 10, such that they are fixed to the bracket itself,
- the second assembly bracket 66 is configured to receive a second portion of the first manifold 1 and a corresponding second portion of the second manifold 10, such that they are fixed to the bracket itself; Preferably, in the first assembly configuration (FIGS. 3-5):
- the first portion of the first manifold 1, which can be mounted on the first assembly bracket 61, corresponds to the first inlet/outlet end 3 of the first manifold, and the corresponding first portion of the second manifold 10, which can be mounted on the first assembly bracket 61, corresponds to the respective first inlet/outlet end 13 of the second manifold 10;
- the second portion of the first manifold 1, which can be mounted on the second assembly bracket 66, corresponds to the second inlet/outlet end 4 of the first manifold, and the corresponding second portion of the second manifold 10, which can be mounted on the second assembly bracket 66, corresponds to the respective second inlet/outlet end 14 of the second manifold 10.

Preferably, in the second assembly configuration (FIGS. 6-8):

- the first portion of the first manifold 1, which can be mounted on the first assembly bracket 61, corresponds to the first inlet/outlet end 3 of the first manifold 1, and the corresponding first portion of the second manifold 10, which can be mounted on the first assembly bracket 61, corresponds to the second inlet/outlet end 14 of the second manifold 10;
- the second portion of the first manifold 1, which can be mounted on the second assembly bracket 66, corresponds to the second inlet/outlet end 4 of the first manifold 1, and the corresponding second portion of the second manifold 10, which can be mounted on the second assembly bracket 66, corresponds to the first inlet/outlet end 13 of the second manifold 10.

Preferably, the first assembly bracket 61 and the second assembly bracket 66 are identical to each other and interchangeable.

Preferably, the first assembly bracket 61 and the second assembly bracket 66 do not change their position or orientation both if the kit 50 operates in the first assembly configuration, or if the kit 50 operates in the second assembly configuration (only the position of one of the two manifolds reverses—overturns).

Preferably, the distribution kit 50 is configured to be mounted, both in the first assembly configuration and in the second assembly configuration, in such a way that all the first access or exit openings 8 of the branches 5 and 15 of the first 1 and second manifold 10 are oriented downwards.

Preferably, the distribution kit 50 comprises a plurality of branch pipes 30 and 40, each branching off from a respective branch 5 or 15 of the first manifold 1 or of the second manifold 10.

In the figures, the branch pipes of the first manifold are identified with the numeral 30, while the branch pipes of the second manifold are identified with 40. All these pipes can be identical to each other (for example pipes made of plastic or multilayer material, or metal pipes).

Preferably:

in the first configuration (FIGS. 3-5), the pipes 30 of the branches 5 of the first manifold 1 are aligned and substantially coaxial with respect to the corresponding pipes 40 of the second manifold 10 (placed above the first manifold); the pipes 40 of the second manifold 10 pass behind the first manifold, between the rear surface of the first manifold and an assembly wall on which the kit can be positioned or is positioned;

in the second configuration (FIGS. 6-8), the pipes 30 of the branches 5 of the first manifold 1 are laterally, and in parallel, staggered with respect to the pipes 40 of the second manifold 10 (placed above the first manifold); the pipes 40 of the second manifold 10 pass behind the first manifold, between the rear surface of the first manifold and an assembly wall on which the kit can be positioned or is positioned, in such a way as to be alternated, or interleaved, with respect to the pipes 30 of the first manifold 1.

Preferably, the branches 5 of the first manifold 1 (if operating as a delivery manifold, as in the figures) are provided with respective second openings 9, and the kit 50 comprises a plurality of flow meters/regulators 21, each mountable to the second opening 9 of a respective branch 5 and configured to set the flow rate exiting, through the first outlet opening 8 of the branch, from the pipe 30 associated with this respective branch.

Preferably, the branches 15 of the second manifold 10 (if operating as a return manifold, as in the figures) are provided with respective second openings 9, and the kit 50 comprises a plurality of interception valves 22, each mountable to the second opening 9 of a respective branch 15 and configured to open or close the passage of fluid entering the pipe 40 associated to such a respective branch.

Conversely, if the first manifold operates as a return manifold and the second manifold operates as a delivery manifold, the plurality of interception valves is combined with the first manifold and the plurality of flow meters/regulators, is combined with the second manifold.

A mixing system according to the present invention comprises:

a distribution kit 50 as illustrated above, which can be mounted in one of the first and second assembly configurations;

a plurality of components including conduits, valves and/or one or more pumps, which form at least one delivery branch and one return branch of the mixing system (as known in the plumbing or heating systems sector, in particular floor).

The system provides that:

with the kit 50 in the first assembly configuration (FIGS. 3-5), at least the first inlet/outlet end 3 of the first manifold 1 is placed in fluid communication with the delivery branch of the mixing system, to receive therefrom the fluid entering the distribution conduit 2 of the first manifold 1, and at least the first inlet/outlet end 13 of the second manifold 10 is placed in fluid communication with the return branch of the mixing system, to send thereto fluid exiting the respective distribution conduit 12 of the second manifold 10; or with the kit 50 in the second assembly configuration (FIGS. 6-8), at least the first inlet/outlet end 3 of the first manifold 1 is placed in fluid communication with the delivery branch of the mixing system, to receive therefrom the fluid entering the distribution conduit 2 of the first manifold 1, and at least the second inlet/outlet end 14 of the second manifold 10 is placed in fluid communication with the return branch of the mixing system, to send thereto fluid exiting the distribution conduit 12 of the second manifold 10.

A method for assembling a distribution kit according to the present invention is illustrated below, which essentially corresponds to a method of use of the kit 50 and of the manifold 1 according to the present invention.

The method comprises the steps of:

preparing a first manifold 1;

providing a second manifold 10, preferably structurally and/or dimensionally identical or equivalent to the first manifold 1;

providing assembly members 60 intended to be fixed to an assembly wall on which the kit is to be positioned, and configured to receive and support the first manifold 1 and the second manifold 10, such that the manifolds are stably positioned, preferably removably, with respect to the assembly members and therefore with respect to the assembly wall, assembling the first manifold 1 and the second manifold 10 to the assembly members 60, such that the two manifolds 1 and 10 are vertically aligned with each other, with the first manifold above the second manifold or vice versa the second manifold above the first manifold, and preferably with the respective longitudinal axes L parallel to each other.

The step of assembling the first manifold 1 and the second manifold 10 to the assembly members 60 can take place according to at least one of the following assembly configurations:

a first assembly configuration (FIGS. 3-5), in which the first inlet/outlet end 3 of the first manifold 1 is vertically aligned with the respective first inlet/outlet end 13 of the second manifold 10, the second inlet/outlet end 4 of the first manifold 1 is vertically aligned with the respective second inlet/outlet end 14 of the second manifold 10, and each branch 5 of the first manifold has its axis D coincident with the respective axis D' of a corresponding branch 15 of the second manifold (placed above the first manifold in the figures, but which can be equally positioned below the first manifold);

a second assembly configuration, in which the first inlet/outlet end 3 of the first manifold 1 is vertically aligned with the second inlet/outlet end 14 of the second manifold 10, the second inlet/outlet end 4 of the first manifold 1 is vertically aligned with the first inlet/outlet end 13 of the second manifold 10, and the branches 5 of the first manifold are laterally staggered with respect to the branches 15 of the second manifold 10 (placed above the first manifold in the figures, but equally positionable below the first manifold)), so that each branch 5 of the first manifold has its axis D interposed, substantially halfway, between the respective axes D' of two adjacent branches 15 of the second manifold 1'0, with the axes D of the branches 5 of the first manifold parallel to the axes D' of the branches 15 of the second manifold.

A process for assembling a mixing system, according to the present invention, comprises the steps of:

providing at least one distribution kit 50, which can be selectively mounted in the first or second assembly configuration;

providing a plurality of components (not shown in the figures) among which pipes, valves and/or one or more pumps, which form at least a delivery branch and a return branch of the mixing system;

selecting one between the first assembly configuration and the second assembly configuration;

performing the assembly of the first manifold 1 and of the second manifold 10 to the assembly members 60, according to the selected assembly configuration.

The method further comprises one of the following steps, depending on the selected assembly configuration:

if the first assembly configuration for the kit 50 is selected, placing the first inlet/outlet end 3 of the first manifold 1 in fluid communication (i.e. connecting hydraulically) with the delivery branch of the mixing system to receive therefrom the fluid entering the distribution conduit 2 of the first manifold 1, and placing the first inlet/outlet end 13 of the second manifold 10 in fluid communication (i.e. connecting hydraulically) with the return branch of the mixing system to send thereto fluid exiting the distribution conduit 12 of the second manifold 10;

if the second assembly configuration for the kit 50 is selected, placing the first inlet/outlet end 3 of the first manifold 1 in fluid communication with the delivery branch of the mixing system to receive therefrom the fluid entering the distribution conduit 2 of the first manifold 1, and placing the second inlet/outlet end 14 of the second manifold 10 in fluid communication with the return branch of the mixing system to send thereto fluid exiting the distribution conduit 12 of the second manifold 10.

The invention thus conceived is subject to numerous modifications and variants, all falling within the scope of the inventive concept, and the components mentioned may be replaced by other technically equivalent elements.

The invention therefore achieves important advantages. First of all, as is clear from the above description, the invention allows at least some of the drawbacks of the prior art to be overcome.

Before explaining in detail the technical effects and advantages of the solution described, it should be noted that in the context of the present description and claims, the expression "substantially equal" means that the formula with which the length of a manifold is constructed (and in particular the length of the final stretch Y) according to the present invention determines a precise value, which may however vary slightly without departing from the teachings and protection of the present application. In other words, what matters is the succession "initial stretch—centre-to-centre distance—final stretch", where the final stretch corresponds to the initial stretch plus half of the centre-to-centre distance (or half step): this is the technical solution underlying the present invention, which allows—as illustrated below—specific technical effects to be obtained. A manifold which has a structure similar to that established by the construction formula and similar technical effects, but slightly different dimensions, is to be considered completely equivalent to a manifold according to the present invention. The illustrated technical solution, in particular the definition of a manifold according to the above formula, is not incidental or arbitrary, but carries with it specific technical effects. In fact, inside a distribution kit 50, the two manifolds 1 and 10 can advantageously be completely identical to each other, and can also be mounted in the two illustrated configurations (first and second) without the vertical alignment of the left and right ends of the two manifolds. In fact, both in the first assembly configuration and in the second assembly configuration the distribution kit 50 has:

a left side (on the left in FIGS. 3-4 and 6-7) in which an inlet/outlet end (first 3 or second 4) of the first manifold 1 is vertically aligned with an inlet/outlet end (the first 13 or the second 14) of the second manifold 10; and a right side (on the right in FIGS. 3-4 and 6-7) in which the other inlet/outlet end (the second 4 or the first 3) of the first manifold 1 is vertically aligned with the other inlet/outlet end (the second 14 or the first 13) of the second manifold 10.

In practice, in order to switch from the first to the second assembly configuration (and vice versa) it is sufficient to "flip" one of the two manifolds 1 or 10 from left to right, inverting the first inlet/outlet end with the second inlet/outlet end. In the first configuration, a coincidence is obtained between the axes D of the branches of the first manifold and the axes D' of the branches of the second manifold (and therefore between the pipes 30 of the first manifold and the pipes 40 of the second manifold), while in the second configuration, a precise staggering/alternation is obtained between the pipes 30 of the first manifold and the pipes 40 of the second manifold. All this without ever vertically misaligning the ends of the manifolds on the left and right side of the distribution kit.

This perfect modularity of the manifold, which can be used in two identical specimens within the kit, is obtained thanks to the definition of the initial stretch X and the final stretch Y based on the construction illustrated by the formula described above, which clarifies how the X and Y are correlated with each other and with the centre-to-centre distance measurement A between the branches.

The manifold described is therefore universal for the two assembly configurations, and allows solving the problems of the known solutions, exposed in the initial part of the description.

In fact, it is possible to mount the two manifolds of the kit both with the branches (and therefore the respective pipes) aligned, and with the branches (and the respective pipes) alternating with each other, without this causing a lateral displacement of the ends of the manifolds on the left and right side.

In the prior art with "staggered" pipes, however, the manifolds are misaligned and this is a serious drawback, since the loss of lateral alignment does not allow direct connection of the kit to the further mixing devices (valves, pumps, conduits, etc.) placed upstream or downstream of the two manifolds, and therefore it becomes necessary to add spacers or extensions.

Furthermore, in the known solution, the staggered assembly requires special brackets, while in the present case the two assembly brackets used can be completely identical to each other and interchangeable, and furthermore it is not necessary to move or relocate the brackets according to the assembly configuration (first or second) selected.

According to the present invention, it is sufficient to overturn one of the manifolds (identical to the other) and mount it to the two identical brackets (positioned in the same way) to switch from one assembly configuration to the other.

The solution of the present invention therefore provides an enormous advantage from the production point of view: it is not in fact necessary to prepare special brackets, nor particular production processes. In fact, the stretches X and Y of the manifold are made in the same way, and the manifold can be obtained from a tubular of a known type (also already used for traditional manifolds according to the prior art): the difference lies in the specific dimensional modification of the stretches of the manifold, according to the above formula, which illustrates the dimensioning of the manifold on the basis of the centre-to-centre distance between the branches. Overall, the solution of the present invention allows a kit to be mounted (with two identical manifolds) both in the "traditional" way (with upper and lower pipes aligned), and in the "staggered" mode (with alternating pipes), according to the needs of the specific installation, in any case connecting everything to standard mixing systems without the need for additional components or items.

The solution according to the present invention overcomes the technical prejudices of the prior art, which in order to solve the problem of the complex assembly of the pipes in the "aligned" condition has always proposed a misalignment obtained with special assembly brackets to move the manifolds laterally, and by providing additional pieces upstream or downstream of the manifolds. In fact, it is now possible to obtain both assemblies by inverting one of the two manifolds without introducing misalignments at the ends, without special brackets and without additional components.

In summary, the same kit comprising only two identical manifolds and two standard brackets intrinsically allows both assemblies to be made.

It should be noted that the presence of a final stretch Y of increased length (of N times half a step, or simply of half a step A/2) with respect to the initial stretches X requires an additional use of material from the tubular body that makes the manifold, however this addition—from an economic and production point of view—is not very relevant, and in any case the solution of the present invention is much less onerous than the known solutions, which have considerable costs due to the special brackets, fittings and additional extensions to be prepared to re-align, to the higher assembly costs, the management of the warehouse and the article codes to be set up for a distribution kit.

Ultimately, the manifold and the distribution kit of the present invention allow carrying out the assembly of a mixing system—according to two completely selectable and interchangeable assembly configurations—in a simple, convenient and rapid manner.

Furthermore, the manifold and the distribution kit of the present invention allow implementing the assembly of a mixing system without the need for special components (such as special assembly brackets or extensions for the manifolds).

Overall, the manifold and the distribution kit of the present invention are characterized by a high versatility of use in the implementation of mixing systems.

Furthermore, the manifold and the distribution kit of the present invention are characterized by a reduced manufacturing cost and by a simple and rapid production process, which can also be implemented on production plants previously used for the production of known solutions.

Finally, as emerges from the entire description, the manifold and the distribution kit of the present invention undoubtedly have a simple and rational structure.

The invention claimed is:

1. Manifold (1) for the distribution of a fluid circulating in a plumbing and heating system, having a tubular shape and defining in its interior a distribution conduit (2) intended to be crossed by a fluid, the manifold (1) extending longitudinally between:

a first inlet/outlet end (3), suitable to put said distribution conduit (2) in communication with the exterior of the manifold (1) and configured to receive fluid entering the manifold or to send fluid exiting the manifold;

a second inlet/outlet end (4), separate from said first inlet/outlet end (3), suitable—at least in an operating condition—to put said distribution conduit (2) in communication with the exterior of the manifold (1) and configured to receive fluid entering the manifold or to send fluid exiting the manifold;

wherein the manifold (1), in use, is configured to operate with at least one of said first inlet/outlet end (3) and second inlet/outlet end (4) which receives fluid entering the manifold or sends fluid exiting the manifold;

the manifold (1) being provided with a plurality of branches (5), mutually distinct and arranged in series along a longitudinal extension of the manifold, interposed between the first inlet/outlet end (3) and the second inlet/outlet end (4), wherein:

the plurality of branches (5) comprises at least a first branch (6) and a final branch (7);

each branch (5) of said plurality of branches defines a respective branch point of the manifold, at which a quantity of fluid in transit in the distribution conduit (2) can exit the distribution conduit towards the exterior or a quantity of fluid coming from the exterior can enter the distribution conduit;

each branch (5) of said plurality of branches comprises at least one respective first access or exit opening (8), configured to allow the exit from the manifold (1) of at least part of the fluid in transit in the distribution conduit (2) or the entrance of fluid inside the distribution conduit (2), said respective first access or exit opening (8) being a hole having a respective axis (D) of the branch;

and wherein the branches (5) of said plurality of branches are positioned, in the manifold (1), in such a way that:

the distance between the first inlet/outlet end (3) and the axis (D) of the first branch (6) is equal to an initial stretch (X) of the manifold;

the distance between the axis (D) of each branch (5) and the axes of adjacent branches, and/or between the axis (D) of the first branch (6) and the axis of the subsequent branch and/or between the axis (D) of the last branch (7) and the axis of the previous branch, is equal to a given centre-to-centre distance measurement (A) between the branches (5) of the manifold;

the distance between the axis (D) of the last branch (7) and the second inlet/outlet end (4) is equal to a final stretch (Y) of the manifold; and wherein the length of said final stretch (Y) is equal to the sum of the length of said initial stretch (X) and N times half of said centre-to-centre distance measurement (A), where N is an odd integer greater than or equal to 1.

2. The manifold (1) according to claim 1, wherein the value of said number N is equal to 1 and the length of said final stretch (Y) is equal to the sum of the length of said initial stretch (X) and half of said centre-to-centre distance measurement (A), and/or wherein said longitudinal extension of the manifold is directed along a longitudinal axis (L) of the manifold, and/or wherein the second inlet/outlet end (4) is longitudinally opposite with respect to the first inlet/outlet opening (3), and/or wherein said initial stretch (X), said centre-to-centre distance measurement (A) and said final stretch (Y) have respective extensions defined by dimensional values in length measured along said longitudinal axis (L) of the manifold.

3. The manifold (1) according to claim 2, wherein said axis (D) of each branch (5, 6, 7) is oriented orthogonally to said longitudinal axis (L) of the manifold, and/or wherein said centre-to-centre distance measurement (A) between the branches (5, 6, 7) corresponds to the distance between the respective axes (D) of two adjacent branches, and/or wherein, considering the centre-to-centre distance measurement (A) between the branches (5) as a step of the manifold, i.e. a value of the distance between the branches (5) suitable to define the manifold, the length of the final stretch (Y) is equal to the length of the initial stretch (X) plus half the step, and/or wherein said centre-to-centre distance measurement (A) is constant among all the branches (5) of the manifold.

4. The manifold (1) according to claim 1, wherein the first branch (6) is the branch arranged in the position closest to the first inlet/outlet end (3) and farthest from the second inlet/outlet end (4), and the last branch (7) is the branch arranged in the position closest to the second inlet/outlet end (4) and farthest from the first inlet/outlet end (3), and/or wherein the further branches (5) of said plurality of branches, in addition to said first branch (6) and said last branch (7), are positioned in sequence between the first branch and the last branch, and/or wherein each further branch (5) in addition to said first branch and said last branch is an internal branch, not adjacent to the first and to the second inlet/outlet end, interposed between a respective previous branch and a respective subsequent branch.

5. The manifold (1) according to claim 1, wherein the manifold is a single-block tubular body, extending between the first inlet/outlet end (3) and the second inlet/outlet end (4) and provided with all of said branches (5, 6, 7), or wherein the tubular body of the manifold is made in a single piece, or wherein the tubular body of the manifold comprises a main body, comprising the first inlet/outlet end (3) and the plurality of branches (5), and a final stretch defining at least partially said final stretch (Y), comprising the second inlet/outlet end (4), said final portion being associated with the main body to form a unitary manifold, and/or wherein said final portion can have an extension equal to the length of said final stretch (Y) or equal to the length of said initial stretch (X) or equal to the length of half of said centre-to-centre distance measurement (A).

6. The manifold (1) according to claim 1, wherein the manifold, in use, is configured:

to operate with the first inlet/outlet end (3) that receives fluid, from the plumbing and heating system, entering the manifold and the second inlet/outlet end (4) closed or connected to a pipe of the plumbing and heating system downstream of the manifold;

or to operate with the second inlet/outlet end (4) that receives fluid, from the plumbing and heating system, entering the manifold and the first inlet/outlet end (3) closed or connected to a pipe of the plumbing and heating system downstream of the manifold, and/or wherein the first access or exit opening (8) of each branch (5, 6, 7) is configured to receive in connection a respective branch pipe (30), configured to receive a flow of fluid from the distribution conduit (2), or to introduce a flow of fluid into the distribution conduit (2), and/or wherein said first inlet/outlet end (3) and/or said second inlet/outlet end (4) comprise respective means for connection to a part, upstream or downstream, of the plumbing and heating system to receive fluid entering the manifold or send fluid exiting the manifold (1).

7. The manifold (1) according to claim 1, wherein all the first access or exit openings (8) of all the branches (5, 6, 7) are mutually aligned, such that the axes (D) of all the branches are mutually parallel and all lie on a same median plane of the manifold, and wherein the median plane of the manifold longitudinally divides the manifold into two halves, and crosses the first inlet/outlet end (3), the second inlet/outlet end (4) and the access or exit openings (8) of the branches, and/or wherein one or more of said branches (5, 6, 7) comprises a second opening (9), aligned with the respective first access or exit opening (8) along the respective axis (D) of the branch, wherein the second openings (9) of the branches (5, 6, 7) are configured to allow the connection, to the respective branch, of a control device (20) active on the respective branch, wherein the control device (20) active on a respective branch (5) can be assembled to the second opening (9) of the branch, so as to cross the inside of the distribution conduit (2) of the manifold and act on the first access or exit opening (8) of the branch (5) to control and regulate the flow of fluid exiting, or entering, the respective branch pipe (30).

8. Distribution kit (50) comprising:

a first manifold (1), according to claim 1;

a second manifold (10), structurally and/or dimensionally identical or equivalent to said first manifold (1);

assembly members (60) intended to be fixed to an assembly wall on which the kit is to be positioned, and configured to receive and support the first manifold (1) and the second manifold (10), such that the manifolds (1, 10) are stably positioned with respect to the assembly members (60) and therefore with respect to the assembly wall, and such that the first (1) and the second manifold (10) are vertically aligned with each other, with the first manifold above the second manifold or vice versa the second manifold above the first manifold, and with the respective longitudinal axes (L) parallel to each other; and wherein the distribution kit (50) is configured to allow the assembly of the first and second manifold to the assembly members at least according to one of the following assembly configurations:

a first assembly configuration, in which the first inlet/outlet end (3) of the first manifold (1) is vertically aligned with the respective first inlet/outlet end (13) of the second manifold (10), the second inlet/outlet end (4) of the first manifold (1) is vertically aligned with the respective second inlet/outlet end (14) of the second manifold (10), and each branch (5) of the first manifold has its axis (D) coincident with the respective axis (D') of a corresponding branch (15) of the second manifold (10);

a second assembly configuration, in which the first inlet/outlet end (3) of the first manifold (1) is vertically aligned with the second inlet/outlet end (14) of the second manifold (10), the second inlet/outlet end (4) of the first manifold (1) is vertically aligned with the first inlet/outlet end (13) of the second manifold (10), and the branches (5) of the first manifold are laterally staggered with respect to the branches (15) of the second manifold, so that each branch (5) of the first manifold has its axis (D) interposed, halfway, between the respective axes (D') of two adjacent branches of the second manifold, with the axes (D) of the branches (5) of the first manifold (1) parallel to the axes (D') of the branches (15) of the second manifold (10).

9. The kit (50) according to claim 8, wherein said first manifold (1) operates as a delivery manifold and said second manifold (10) operates as a return manifold, or vice versa, and wherein between the first and the second assembly configuration the orientation of the second manifold (10) with respect to the first (1) is reversed, i.e. the second manifold is rotated 180° about an axis orthogonal to its longitudinal axis (L), and/or wherein in the first assembly configuration the respective first inlet/outlet ends (3, 13) of the first and second manifold are vertically aligned on one and the same side of the kit and the respective second inlet/outlet ends (4, 14) of the first and second manifold are vertically aligned on an opposite side of the kit, and/or wherein in the second assembly configuration the first inlet/outlet end (3) of the first manifold and the second inlet/outlet end (14) of the second manifold are vertically aligned on a same side of the kit and the second inlet/outlet end (4) of the first manifold and the first inlet/outlet end (13) of the second manifold are vertically aligned on an opposite side of the kit, and/or wherein both in the first assembly configuration and in the second assembly configuration, the distribution kit (50) has a left side wherein an inlet/outlet end (3; 4) of the first manifold (1) is vertically aligned with an inlet/outlet end (13; 14) of the second manifold (10), and a right side—opposite to the left side with respect to the longitudinal extension (L) of the manifolds—wherein the other inlet/outlet end (4; 3) of the first manifold (1) is vertically aligned with the other inlet/outlet end (14; 13) of the second manifold (10).

10. The kit (50) according to claim 8, wherein the assembly members (60) comprise at least one assembly bracket (61) provided with a rear side (62), intended to be fixed to an assembly wall on which the kit is to be positioned, and a front side (63), intended to receive and house a portion of the first manifold (1) and a corresponding portion of the second manifold (10), mutually vertically aligned, and/or wherein the assembly bracket (61) has a prevalent longitudinal extension and can be positioned orthogonally to the longitudinal extension (L) of the first and second manifold, and/or wherein the assembly bracket (61) is provided with:

a first tightening ring (64), arranged in a first position on its front side, and configured to externally wrap around a portion of the first manifold (1) so as to make it integral with the bracket itself;

a second tightening ring (65), arranged in a second position on its front side, distinct from the first position and defined below the first position, and configured to externally wrap around a portion of the second manifold (10) so as to make it integral with the bracket itself.

11. The kit (50) according to claim 8, wherein the assembly members (60) comprise a pair of said assembly brackets, intended to both be fixed to the assembly wall, wherein:

the first assembly bracket (61) is configured to receive a first portion of the first manifold (1) and a corresponding first portion of the second manifold (10), such that they are fixed to the bracket itself, the second assembly bracket (66) is configured to receive a second portion of the first manifold (1) and a corresponding second portion of the second manifold (10), such that they are fixed to the bracket itself;

and/or wherein the first assembly bracket (61) and the second assembly bracket (66) are mutually identical and interchangeable, and/or wherein the first assembly bracket (61) and the second assembly bracket (66) do not vary their position or orientation whether the kit operates in the first assembly configuration or the kit operates in the second assembly configuration.

12. The kit (50) according to claim 8, comprising a plurality of branch pipes (30, 40), each branching off from a respective branch of the first or second manifold, and wherein:

in the first configuration the pipes (30) of the branches (5) of the first manifold (1) are aligned and coaxial with respect to the corresponding pipes (40) of the second manifold (10);

in the second configuration the pipes (30) of the branches (5) of the first manifold (1) are laterally, and in parallel, staggered with respect to the pipes (40) of the second manifold (10), which are alternated, or intercalated, with respect to the pipes (30) of the first manifold;

and/or wherein the branches (5) of the first manifold (1), if operating as a delivery manifold, are provided with respective second openings (9), and the kit (50) comprises a plurality of flow rate meters/regulators (21), each mountable to the second opening (9) of a respective branch (5) and configured to set the flow rate exiting the pipe (30) of said respective branch, and wherein the branches (15) of the second manifold (10), if operating as a return manifold, are provided with respective second openings (9), and the kit (50) comprises a plurality of interception valves (22), each mountable to the second opening of a respective branch (15) and configured to open or close the passage of fluid entering from the pipe (40) of said respective branch, or vice versa.

13. Mixing system comprising at least one distribution kit (50) according to claim 8, mountable in one of said first or second assembly configurations, and further comprising a plurality of components among which pipes, valves and/or one or more pumps, forming at least a delivery branch and a return branch of the mixing system, wherein:

with the kit (50) in said first assembly configuration, at least the first inlet/outlet end (3) of the first manifold (1) is placed in fluid communication with said delivery branch of the mixing system, to receive therefrom the fluid entering the distribution conduit of the first manifold, and at least the first inlet/outlet end (13) of the second manifold (10) is placed in fluid communication with said return branch of the mixing system, to send thereto fluid exiting the distribution conduit of the second manifold; or with the kit (50) in said second assembly configuration, at least the first inlet/outlet end (3) of the first manifold (1)

is placed in fluid communication with said delivery branch of the mixing system, to receive therefrom the fluid entering the distribution conduit of the first manifold, and at least the second inlet/outlet end (14) of the second manifold (10) is placed in fluid communication with said return branch of the mixing system, to send thereto fluid exiting the distribution conduit of the second manifold.

14. Method for assembling a distribution kit (50), comprising the steps of:

providing a first manifold (1), according to claim 1;

providing a second manifold (10), structurally and/or dimensionally identical or equivalent to said first manifold (1);

providing assembly members (60) intended to be fixed to an assembly wall on which the kit is to be positioned, and configured to receive and support the first manifold and the second manifold, such that the manifolds are stably positioned with respect to the assembly members and therefore with respect to the assembly wall, assembling the first manifold (1) and the second manifold (10) to the assembly members (60), such that the two manifolds are vertically aligned with each other, with the first manifold above the second manifold or vice versa the second manifold above the first manifold, and with the respective longitudinal axes (L) parallel to each other;

wherein said step of assembling the first manifold and the second manifold to the assembly members can take place according to at least one of the following assembly configurations:

a first assembly configuration, in which the first inlet/outlet end (3) of the first manifold (1) is vertically aligned with the respective first inlet/outlet end (13) of the second manifold (10), the second inlet/outlet end (4) of the first manifold (1) is vertically aligned with the respective second inlet/outlet end (14) of the second manifold (10), and each branch (5) of the first manifold has its axis (D) coincident with the respective axis (D') of a corresponding branch (15) of the second manifold (10);

a second assembly configuration, wherein the first inlet/outlet end (3) of the first manifold (1) is vertically aligned with the second inlet/outlet end (14) of the second manifold (10), the second inlet/outlet end (3) of the first manifold (1) is vertically aligned with the first inlet/outlet end (13) of the second manifold (10), and the branches (5) of the first manifold are laterally staggered with respect to the branches (15) of the second manifold, so that each branch (5) of the first manifold has its own axis (D) interposed, halfway, between the respective axes (D') of two adjacent branches (15) of the second manifold, with the axes (D) of the branches of the first manifold parallel to the axes (D') of the branches of the second manifold.

15. Method for assembling a mixing system, comprising the steps of:

providing at least one distribution kit (50) according to claim 8, mountable in one of said first or second assembly configurations;

providing a plurality of components among which pipes, valves and/or one or more pumps, forming at least a delivery branch and a return branch of the mixing system;

selecting one of said first assembly configuration and second assembly configuration and performing the assembly of the first manifold (1) and of the second manifold (10) to the assembly members (60);

wherein the method further comprises one of the following steps, depending on the selected assembly configuration:

if the first assembly configuration for the kit (50) is selected, placing at least the first inlet/outlet end (3) of the first manifold (1) in fluid communication with said delivery branch of the mixing system to receive therefrom the fluid entering the distribution conduit of the first manifold, and provided at least the first inlet/outlet end (13) of the second manifold (10) in fluid communication with said return branch of the mixing system to send thereto fluid exiting the distribution conduit of the second manifold;

if the second assembly configuration for the kit (50) is selected, placing at least the first inlet/outlet end (3) of the first manifold (1) in fluid communication with said delivery branch of the mixing system to receive therefrom the fluid entering the distribution conduit of the first manifold, and placing at least the second inlet/outlet end (14) of the second manifold (10) in fluid communication with said return branch of the mixing system to send thereto fluid exiting the distribution conduit of the second manifold.

* * * * *